US010373572B2

(12) United States Patent
Sako et al.

(10) Patent No.: US 10,373,572 B2
(45) Date of Patent: Aug. 6, 2019

(54) DISPLAY DEVICE, ELECTRONIC APPARATUS, AND METHOD FOR DRIVING DISPLAY DEVICE

(71) Applicant: Japan Display Inc., Minato-ku (JP)

(72) Inventors: Kazuhiko Sako, Minato-ku (JP); Naoyuki Takasaki, Minato-ku (JP); Tsutomu Harada, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 545 days.

(21) Appl. No.: 15/016,341

(22) Filed: Feb. 5, 2016

(65) Prior Publication Data

US 2016/0260395 A1 Sep. 8, 2016

(30) Foreign Application Priority Data

Mar. 5, 2015 (JP) ..... 2015-043950

(51) Int. Cl.
*G09G 3/36* (2006.01)
*G09G 3/34* (2006.01)

(52) U.S. Cl.
CPC ..... *G09G 3/3607* (2013.01); *G09G 3/3426* (2013.01); *G09G 3/3648* (2013.01); *G09G 2300/0443* (2013.01); *G09G 2300/0452* (2013.01); *G09G 2320/0242* (2013.01); *G09G 2320/0646* (2013.01);
(Continued)

(58) Field of Classification Search
CPC .. G09G 5/00; G09G 5/02; G09G 3/36; H04N 5/33; H04N 9/04; H04N 9/31; H04N 9/67; H04N 9/68; G03F 3/08
See application file for complete search history.

(56) References Cited

U.S. PATENT DOCUMENTS

2005/0184998 A1* 8/2005 Yang ..... G09G 3/3406 345/589
2009/0160747 A1* 6/2009 Morisue ..... G09G 3/3406 345/88

(Continued)

FOREIGN PATENT DOCUMENTS

JP 2012-108518 6/2012
JP 2015-108818 6/2015

*Primary Examiner* — Chanh D Nguyen
*Assistant Examiner* — Nguyen H Truong
(74) *Attorney, Agent, or Firm* — Oblon, McClelland, Maier & Neustadt, L.L.P.

(57) ABSTRACT

A display device includes an image display panel, a light source unit, and a signal processing unit. The tentative expansion coefficient calculating unit calculates a tentative expansion coefficient. The tentative index value calculating unit calculates a tentative index value serving as an index of the irradiation amount of light based on the tentative expansion coefficient. The low-saturation pixel detecting unit detects low-saturation pixels in a certain region on an image display surface. The light irradiation amount calculating unit calculates a comparative light irradiation amount based on a detection by the low-saturation pixel detecting unit, a display quality maintenance reference value at which the display quality of colors displayed by the low-saturation pixels is maintained, and an index value calculated based on the tentative index value and calculates, based on the comparative light irradiation amount, a light irradiation amount serving as the irradiation amount of light.

17 Claims, 22 Drawing Sheets

(52) U.S. Cl.
CPC ..... *G09G 2320/0666* (2013.01); *G09G 2330/021* (2013.01); *G09G 2360/148* (2013.01); *G09G 2360/16* (2013.01)

(56) References Cited

U.S. PATENT DOCUMENTS

| | | | | |
|---|---|---|---|---|
| 2009/0207182 | A1* | 8/2009 | Takada ..... | G09G 3/3406 345/589 |
| 2009/0315921 | A1 | 12/2009 | Sakaigawa et al. | |
| 2012/0249404 | A1 | 10/2012 | Sakaigawa et al. | |
| 2015/0109352 | A1 | 4/2015 | Takasaki et al. | |

* cited by examiner

DISPLAY DEVICE, ELECTRONIC APPARATUS, AND METHOD FOR DRIVING DISPLAY DEVICE

CROSS-REFERENCE TO RELATED APPLICATIONS

This application claims priority from Japanese Application No. 2015-043950, filed on Mar. 5, 2015, the contents of which are incorporated by reference herein in its entirety.

BACKGROUND

1. Technical Field

The present disclosure relates to a display device, an electronic apparatus, and a method for driving the display device.

2. Description of the Related Art

In recent years, demand has been increased for display devices for mobile apparatuses such as mobile phones and electronic paper. In such display devices, one pixel includes a plurality of sub-pixels that output light of different colors. Various colors are displayed using one pixel switching ON and OFF of display of the sub-pixels. Display characteristics such as resolution and luminance have been improved year after year in such display devices. However, an aperture ratio is reduced as the resolution increases, and the luminance of a backlight needs to be increased to achieve high luminance, which leads to an increase in power consumption of the backlight.

To solve this problem, a technique has been developed for adding a white sub-pixel serving as a fourth sub-pixel to red, green, and blue sub-pixels serving as first to third sub-pixels known in the art. According to this technique, the white sub-pixel enhances the luminance to lower the current value of the backlight and reduce the power consumption.

To reduce the luminance of the backlight, there has been developed a method of analyzing an image to be displayed, reducing the luminance of the backlight based on the luminance and the saturation of the image, and thus reducing power consumption. If the image is determined not to be a high-luminance or high-saturation image as a result of the analysis of input signals of the image, the method reduces the luminance of the backlight. In the case of a low-saturation image close to an achromatic color, for example, reduction in the brightness caused by the reduction in the luminance of the backlight may possibly be more likely to be recognized by an observer, resulting in deterioration in the image.

To address the disadvantage described above, the present invention aims to provide a display device and an electronic apparatus that can prevent deterioration in display quality and reduce power consumption, and a method for driving the display device.

SUMMARY

According to an aspect, a display device includes an image display panel in which a plurality of pixels is arranged in a two-dimensional matrix, a light source unit that outputs light to the image display panel, and a signal processing unit that controls the pixels based on an input signal of an image and controls an irradiation amount of light from the light source unit. The signal processing unit includes a tentative expansion coefficient calculating unit that calculates, for each of the pixels, a tentative expansion coefficient serving as a tentative coefficient used to expand the input signal of the image. The signal processing unit includes a tentative index value calculating unit that calculates, for each of the pixels, a tentative index value serving as an index used to calculate the irradiation amount of light from the light source unit based on the tentative expansion coefficient. The signal processing unit includes a low-saturation pixel detecting unit that detects low-saturation pixels having saturation based on the input signal lower than certain saturation in a certain region serving as at least one of a plurality of regions obtained by dividing an image display surface of the image display panel. The signal processing unit includes a light irradiation amount calculating unit that calculates a comparative light irradiation amount based on a result of detection performed by the low-saturation pixel detecting unit, a display quality maintenance reference value at which a display quality of a color displayed by the low-saturation pixels is maintained, and an index value calculated based on the tentative index value of pixels included in the certain region and calculates, based on the comparative light irradiation amount, calculates a light irradiation amount serving as the irradiation amount of light output from the light source unit to the certain region.

DETAILED DESCRIPTION

Figure 1:
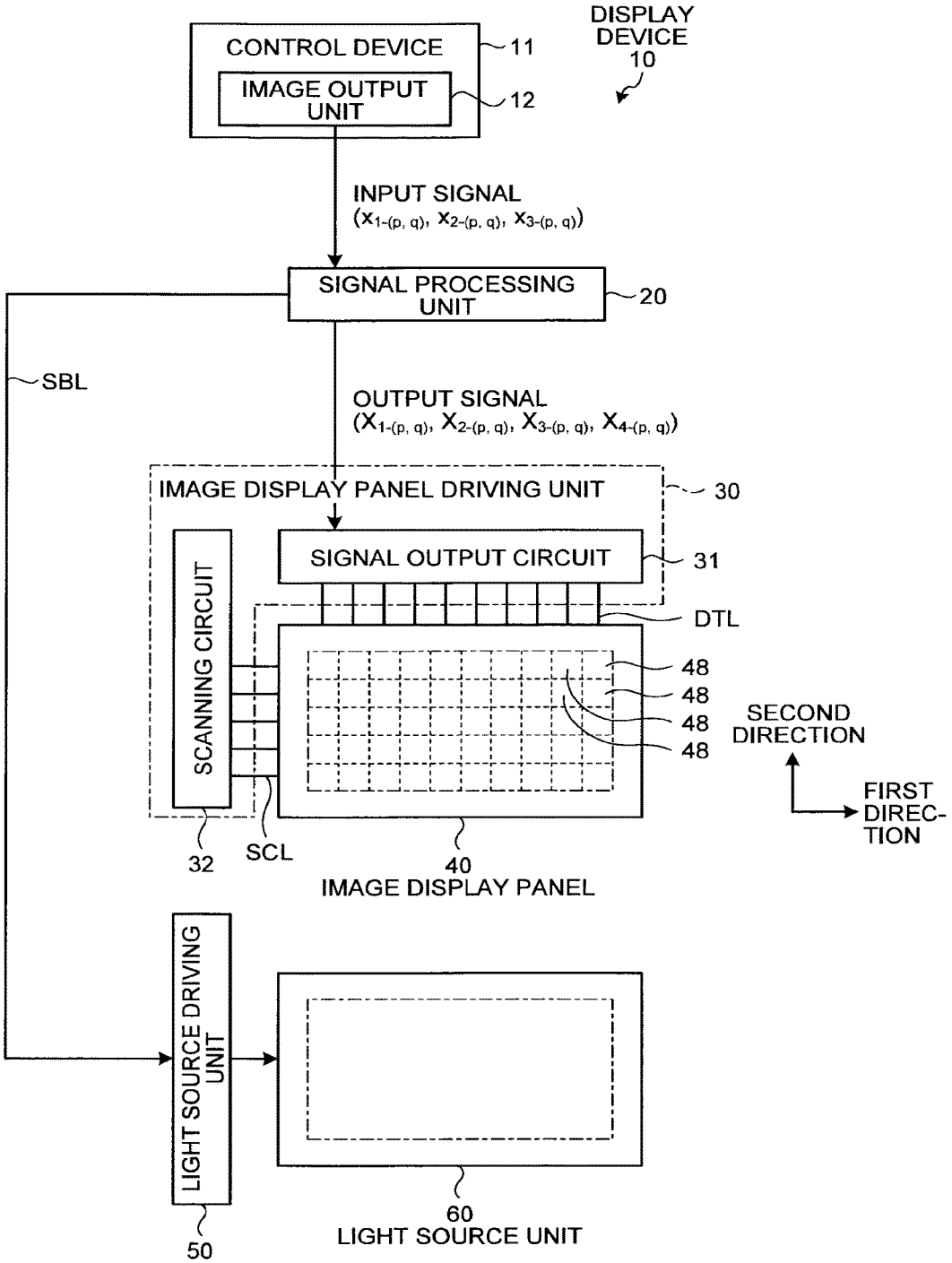
FIG. 1 is a block diagram of an exemplary configuration of a display device according to a first embodiment of the present invention.

The following describes embodiments of the present invention with reference to the accompanying drawings. The disclosure is given by way of example, and the present invention encompasses modifications that maintain the gist of the present invention and are easily conceivable by those skilled in the art. To further clarify the description, the width, thickness, shape, and the like of each component may be schematically illustrated in the drawings as compared to actual aspects, and they are given by way of example and interpretation of the present invention is not limited to them. The same elements as those described in the description with reference to some drawings are denoted by the same reference numerals through the description and the drawings, and detailed descriptions thereof will not be repeated in some cases.

First Embodiment

Entire Configuration of the Display Device

Figure 2:
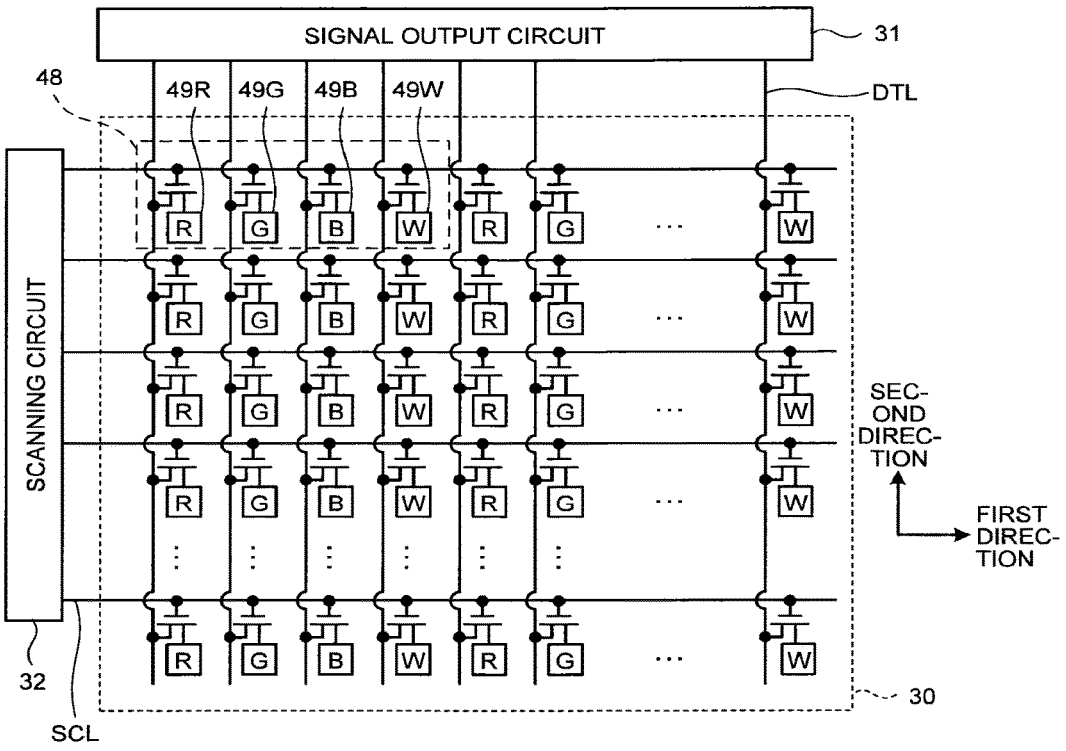
FIG. 2 is a conceptual diagram of an image display panel according to the first embodiment.

FIG. 1 is a block diagram of an exemplary configuration of a display device according to a first embodiment of the present invention. FIG. 2 is a conceptual diagram of an image display panel according to the first embodiment. As illustrated in FIG. 1, a display device 10 according to the first embodiment includes a signal processing unit 20, an image display panel driving unit 30, an image display panel 40, a light source driving unit 50, and a light source unit 60. The signal processing unit 20 receives input signals (RGB data) from an image output unit 12 of a control device 11. The signal processing unit 20 then performs certain data conversion on the input signals and transmits the generated signals to each unit of the display device 10. The image display panel driving unit 30 controls the drive of the image display panel 40 based on the signals received from the signal processing unit 20. The light source driving unit 50 controls the drive of the light source unit 60 based on the signals received from the signal processing unit 20. The light source unit 60 irradiates the back surface of the image display panel 40 with light based on signals received from the light source driving unit 50. The image display panel 40 displays an image with the signals received from the image display panel driving unit 30 and the light output from the light source unit 60.

Configuration of the Image Display Panel

The following describes the configuration of the image display panel 40. As illustrated in FIGS. 1 and 2, the image display panel 40 includes $P_0 \times Q_0$ pixels 48 ($P_0$ in a first direction and $Q_0$ in a second direction) arrayed in a two-dimensional matrix (rows and columns). While the first direction is the horizontal direction (row direction) and the second direction is the vertical direction (column direction), the first and the second directions are not limited thereto. The first direction may be the vertical direction, and the second direction may be the horizontal direction.

The pixels 48 each include a first sub-pixel 49R, a second sub-pixel 49G, a third sub-pixel 49B, and a fourth sub-pixel 49W. The first sub-pixel 49R displays a first color (e.g., red). The second sub-pixel 49G displays a second color (e.g., green). The third sub-pixel 49B displays a third color (e.g., blue). The fourth sub-pixel 49W displays a fourth color (e.g., white). The first, the second, the third, and the fourth colors are not limited to red, green, blue, and white, respectively, and simply need to be different from one another, such as complementary colors. The fourth sub-pixel 49W that displays the fourth color preferably has higher luminance than that of the first sub-pixel 49R that displays the first color, the second sub-pixel 49G that displays the second color, and the third sub-pixel 49B that displays the third color when being irradiated with light of the same lighting amount from the light source. In the following description, the first sub-pixel 49R, the second sub-pixel 49G, the third sub-pixel 49B, and the fourth sub-pixel 49W will be referred to as a sub-pixel 49 when they need not be distinguished from one another. To distinguish and specify a sub-pixel with its position in the array, the fourth sub-pixel in a pixel $\mathbf{48}_{(p,q)}$, for example, is referred to as a fourth sub-pixel $\mathbf{49}W_{(p,q)}$.

The image display panel 40 is a color liquid crystal display panel in which a first color filter that allows the first color to pass through is arranged between the first sub-pixel 49R and an image observer, a second color filter that allows the second color to pass through is arranged between the second sub-pixel 49G and the image observer, and a third color filter that allows the third color to pass through is arranged between the third sub-pixel 49B and the image observer. In the image display panel 40, there is no color filter between the fourth sub-pixel 49W and the image observer. A transparent resin layer may be provided for the fourth sub-pixel 49W instead of the color filter. In this way, by arranging the transparent resin layer, the image display panel 40 can suppress the occurrence of a large level difference in the fourth sub-pixel 49W, otherwise the large level difference occurs because of arranging no color filter for the fourth sub-pixel 49W.

Configuration of the Image Display Panel Driving Unit

As illustrated in FIGS. 1 and 2, the image display panel driving unit 30 includes a signal output circuit 31 and a scanning circuit 32. The image display panel driving unit 30 holds video signals in the signal output circuit 31 and sequentially outputs them to the image display panel 40. More specifically, the signal output circuit 31 outputs an image output signal having a certain electric potential corresponding to the output signal from the signal processing unit 20 to the image display panel 40. The signal output circuit 31 is electrically coupled to the image display panel 40 with signal lines DTL. The scanning circuit 32 controls ON/OFF of a switching element (e.g., a thin-film transistor (TFT)) that controls an operation (light transmittance) of the sub-pixel 49 in the image display panel 40. The scanning circuit 32 is electrically coupled to the image display panel 40 with wiring SCL.

Configuration of the Light Source Driving Unit and the Light Source Unit

Figure 3:
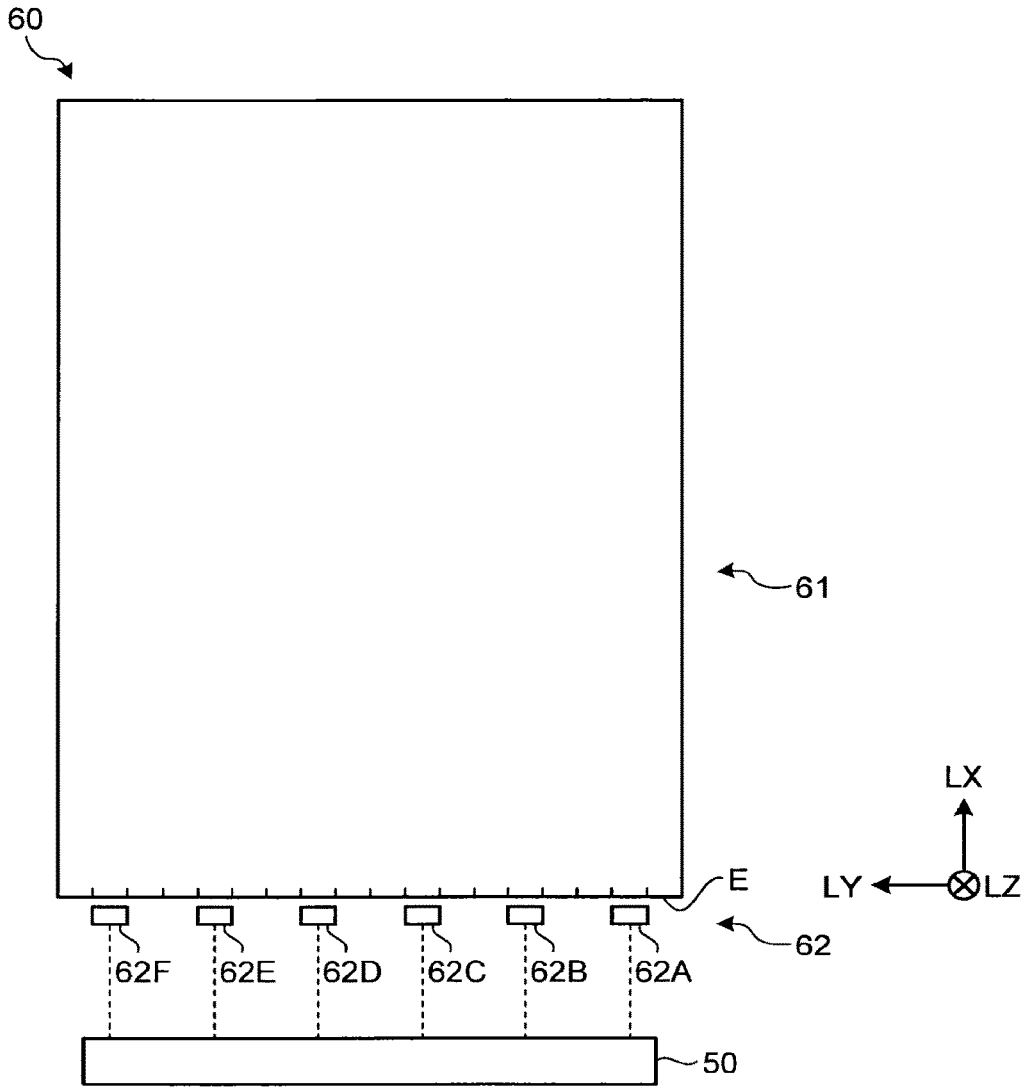
FIG. 3 is a diagram for explaining a light source unit according to the present embodiment.

The light source unit 60 (light source unit) is arranged on the back surface of the image display panel 40. The light source unit 60 outputs light to the image display panel 40, thereby irradiating the image display panel 40. FIG. 3 is a diagram for explaining the light source unit according to the present embodiment. The light source unit 60 includes a light guide plate 61 and a sidelight light source 62. The sidelight light source 62 includes a plurality of light sources 62A, 62B, 62C, 62D, 62E, and 62F arranged facing an entrance surface E of the light guide plate 61. The entrance surface E is at least one of the side surfaces of the light guide plate 61. The light sources 62A to 62F, for example, are light-emitting diodes (LEDs) of the same color (e.g., white). The light sources 62A to 62F are aligned along one side surface of the light guide plate 61. Let us assume a case where LY denotes a light source alignment direction in which the light sources 62A to 62F are aligned. In this case, light from the light sources 62A to 62F enters the light guide plate 61 through the entrance surface E in a light entrance direction LX orthogonal to the light source alignment direction LY.

The light source driving unit 50 controls the amount of light output from the light source unit 60, for example. Specifically, the light source driving unit 50 adjusts an electric current supplied to the light source unit 60 or the duty ratio based on a planar light source device control signal SBL output from the signal processing unit 20. Thus, the light source driving unit 50 controls the irradiation amount of light (intensity of light) output to the image display panel 40. The light source driving unit 50 controls the electric current or the duty ratio individually for the light sources 62A to 62F illustrated in FIG. 3. Thus, the light source driving unit 50 performs divisional drive control on the light sources to control the amount of light (intensity of light) output from the light sources 62A to 62F.

The light guide plate 61 reflects light at both end surfaces in the light source alignment direction LY. As a result, the intensity distribution of light output from the light sources 62A and 62F arranged closer to the end surfaces in the light source alignment direction LY is different from that of light output from the light source 62C, for example, arranged between the light sources 62A and 62F. To address this, the light source driving unit 50 according to the present embodiment needs to control the electric current or the duty ratio individually for the light sources 62A to 62F illustrated in FIG. 3, thereby controlling the amount of output light (intensity of light) based on the light intensity distributions of the light sources 62A to 62F.

In the light source unit 60, the entering light from the light sources 62A to 62F is output in the light entrance direction LX orthogonal to the light source alignment direction LY and enters into the light guide plate 61 through the entrance surface E. The light entering into the light guide plate 61 travels in the light entrance direction LX while diffusing. The light guide plate 61 guides the light output from the light sources 62A to 62F and entering thereinto in an irradiation direction LZ for irradiating the back surface of the image display panel 40. In the present embodiment, the irradiation direction LZ is orthogonal to the light source alignment direction LY and the light entrance direction LX.

Figure 4:
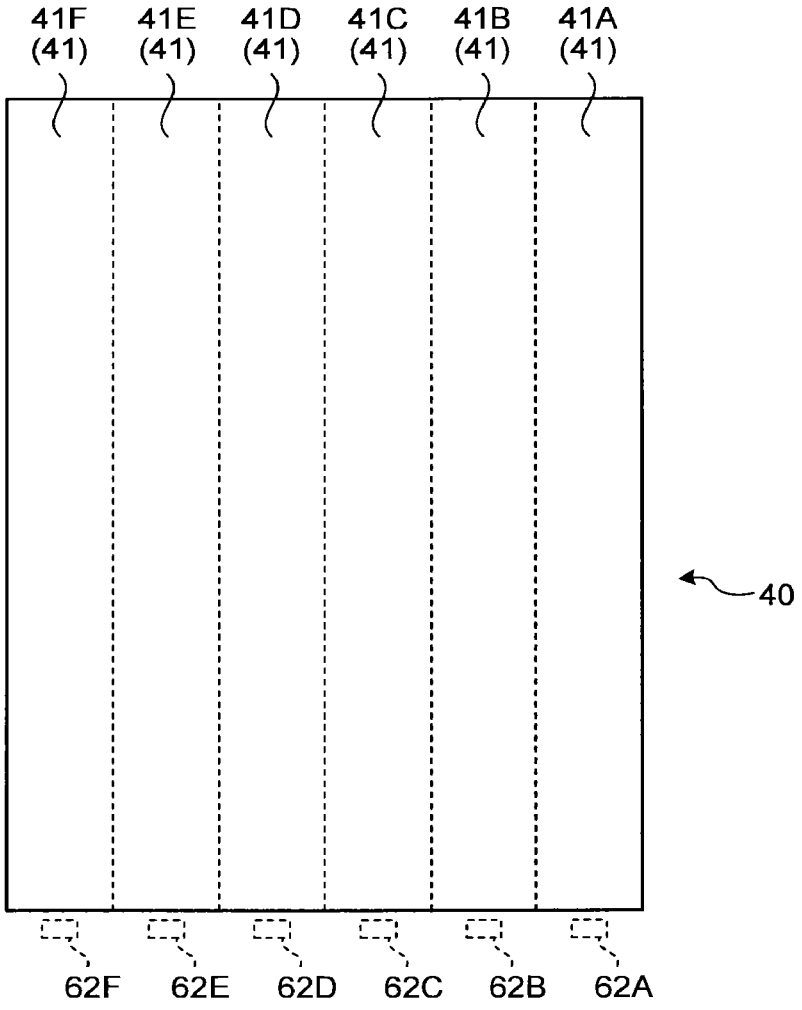
FIG. 4 is a schematic of regions in an image display surface of the image display panel.

FIG. 4 is a schematic of regions in an image display surface of the image display panel. The image display surface is a surface of the image display panel 40 on which an image is displayed. The image display surface is virtually divided into a plurality of regions in a manner corresponding to the arrangement of the light sources 62A to 62F. As illustrated in FIG. 4, the image display surface of the image display panel 40 includes image display regions 41A, 41B, 41C, 41D, 41E, and 41F. The image display region 41A is a region corresponding to the light source 62A and irradiated with light by the light source 62A. Similarly to this, the image display regions 41B to 41F are regions corresponding to the light sources 62B to 62F, respectively, and irradiated with light by the light sources 62B to 62F. In the description below, the image display regions 41A to 41F are appropriately referred to as an image display region 41 when they are not distinguished from one another. The number and the area of the image display regions 41 are optionally determined as long as they correspond to the light sources 62A to 62F. The image display regions 41, for example, may be one image display region corresponding to the entire region of the image display surface of the image display panel 40. In other words, the image display region 41 is a certain region serving as at least one of a plurality of regions obtained by dividing the image display surface of the image display panel 40.

Configuration of the Signal Processing Unit

The signal processing unit 20 processes an input signal received from the control device 11, thereby generating an output signal. The signal processing unit 20 converts an input value of the input signal displayed by combining red (first color), green (second color), and blue (third color) into an extended value (output signal) in an expanded color space (HSV (Hue-Saturation-Value, Value is also called Brightness) color space in the first embodiment) extended by red (first color), green (second color), blue (third color), and white (fourth color). The signal processing unit 20 outputs the generated output signal to the image display panel driving unit 30. The expanded color space will be described later. While the expanded color space according to the first embodiment is the HSV color space, it is not limited thereto. The expanded color space may be another coordinate system, such as the XYZ color space and the YUV color space. The signal processing unit 20 also generates the light source control signal SBL to be output to the light source driving unit 50.

Figure 5:
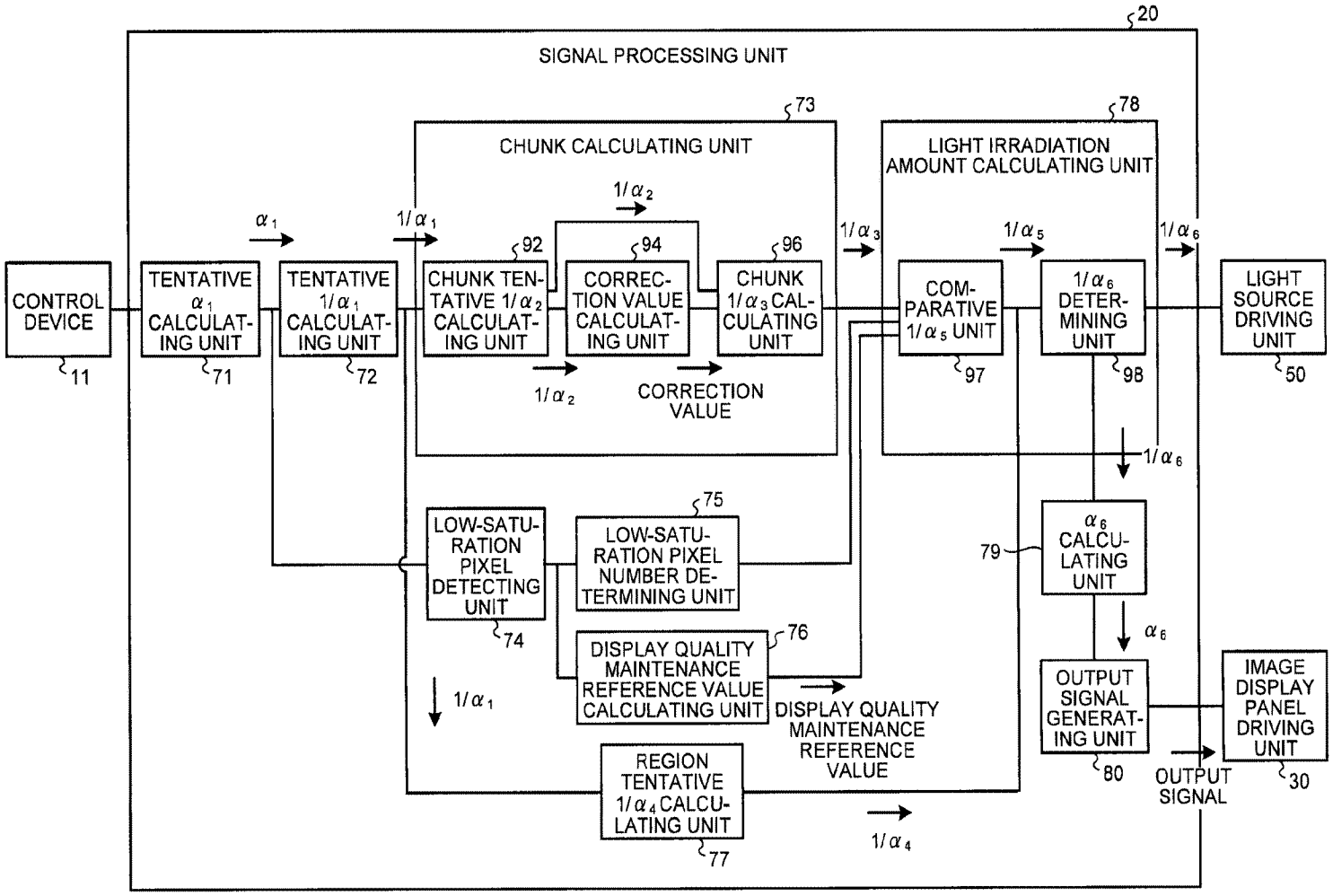
FIG. 5 is a block diagram illustrating an outline of a configuration of a signal processing unit according to the first embodiment.

FIG. 5 is a block diagram illustrating an outline of the configuration of the signal processing unit according to the first embodiment. As illustrated in FIG. 5, the signal processing unit 20 includes a tentative $\alpha_1$ calculating unit 71 (tentative expansion coefficient calculating unit), a tentative $1/\alpha_1$ calculating unit 72 (tentative index value calculating unit), a chunk calculating unit 73, a low-saturation pixel detecting unit 74, a low-saturation pixel number determining unit 75, a display quality maintenance reference value calculating unit 76, a region tentative $1/\alpha_4$ calculating unit 77 (region tentative index value calculating unit), a light irradiation amount calculating unit 78, an $\alpha_6$ calculating unit 79, and an output signal generating unit 80. These units of the signal processing unit 20 may be provided as respective independent components (e.g., circuits) or as a single component.

The tentative $\alpha_1$ calculating unit 71 receives an input signal of an image from the control device 11 and calculates a tentative expansion coefficient $\alpha_1$ serving as a tentative coefficient used to expand the input signal for each pixel 48. The tentative $\alpha_1$ calculating unit 71 calculates the tentative expansion coefficients $\alpha_1$ of all the pixels 48 in the image display panel 40. The tentative $\alpha_1$ calculating unit 71 calculates the saturation and the brightness of a color to be displayed based on the input signal for each pixel 48. Based on the calculated saturation and brightness, the tentative $\alpha_1$ calculating unit 71 calculates the tentative expansion coefficient $\alpha_1$. The tentative $\alpha_1$ calculating unit 71 also calculates the hue of the color to be displayed based on the input signal for each pixel 48. The method for calculating the tentative expansion coefficient $\alpha_1$ and the hue performed by the tentative $\alpha_1$ calculating unit 71 will be described later.

The tentative $1/\alpha_1$ calculating unit 72 acquires the information on the tentative expansion coefficient $\alpha_1$ of each pixel 48. Based on the tentative expansion coefficient $\alpha_1$ of each pixel 48, the tentative $1/\alpha_1$ calculating unit 72 calculates a tentative index value $1/\alpha_1$ of each pixel 48. The tentative $1/\alpha_1$ calculating unit 72 calculates the tentative index values $1/\alpha_1$ of all the pixels 48 in the image display panel 40. The tentative index value $1/\alpha_1$ is an index used to calculate the irradiation amount of light output from the light source unit 60. As the tentative index value $1/\alpha_1$ according to the first embodiment increases, the light-source lighting amount in the light source unit 60 increases (the reduction rate of the light irradiation amount decreases). As the tentative index value $1/\alpha_1$ decreases, the light-source lighting amount in the light source unit 60 decreases (the reduction rate of the light irradiation amount increases). The tentative index value $1/\alpha_1$ has a value of $1/\alpha_1$. In other words, the tentative index value $1/\alpha_1$ of a pixel 48 is the reciprocal of the tentative expansion coefficient $\alpha_1$ of the pixel 48.

The chunk calculating unit 73 determines whether the tentative index value $1/\alpha_1$ is continuous in a plurality of pixels 48. If it is determined that the tentative index value $1/\alpha_1$ is continuous, the chunk calculating unit 73 determines the region of the continuous pixels 48 to be a chunk. The chunk calculating unit 73 determines the tentative index value $1/\alpha_1$ of the continuous pixels 48 to be a chunk tentative index value $1/\alpha_2$. Based on the chunk tentative index value $1/\alpha_2$, the chunk calculating unit 73 calculates a chunk index value $1/\alpha_3$. More specifically, the chunk calculating unit 73 includes a chunk tentative $1/\alpha_2$ calculating unit 92 (chunk tentative index value calculating unit), a correction value calculating unit 94, and a chunk $1/\alpha_3$ calculating unit 96 (chunk index value calculating unit).

The chunk tentative $1/\alpha_2$ calculating unit 92 acquires the information on the tentative index value $1/\alpha_1$ to determine whether the tentative index value $1/\alpha_1$ is continuous in a plurality of pixels 48. If it is determined that the tentative index value $1/\alpha_1$ is continuous, the chunk tentative $1/\alpha_2$ calculating unit 92 determines that the region of the continuous pixels 48 to be a chunk. Thus, the chunk tentative $1/\alpha_2$ calculating unit 92 detects a chunk in a target image display region 41. The chunk tentative $1/\alpha_2$ calculating unit 92 determines the tentative index value $1/\alpha_1$ of the continuous pixels 48 to be the chunk tentative index value $1/\alpha_2$. In other words, the chunk is a group of pixels 48 having a continuous tentative index value $1/\alpha_1$. The chunk tentative index value $1/\alpha_2$ is a tentative index used to calculate the irradiation amount of light output from the light source unit 60 to the pixels 48 constituting the chunk. Therefore, the chunk tentative index value $1/\alpha_2$ corresponds to the tentative index value $1/\alpha_1$. In a case where the chunk tentative index value $1/\alpha_2$ is equal to the tentative index value $1/\alpha_1$, and the light source unit 60 outputs light based on the values, the light source unit 60 outputs the same amount of light. The method for calculating the chunk tentative index value $1/\alpha_2$ performed by the chunk tentative $1/\alpha_2$ calculating unit 92 will be described later.

The correction value calculating unit 94 acquires the information on the chunk detected by the chunk tentative $1/\alpha_2$ calculating unit 92 and the information on the hue of each pixel 48 to calculate the hues of the pixels 48 constituting the chunk. Based on the hues of the pixels 48 constituting the chunk, the correction value calculating unit 94 calculates a hue correction value CV used to correct the chunk tentative index value $1/\alpha_2$. While the correction value calculating unit 94 acquires the information on the hue of each pixel 48 calculated by the tentative $\alpha_1$ calculating unit 71, the correction value calculating unit 94 may calculate the hues of the pixels 48 constituting the chunk based on the input signals.

The chunk $1/\alpha_3$ calculating unit 96 acquires the information on the chunk tentative index value $1/\alpha_2$ and the hue correction value CV of the chunk. Based on the chunk tentative index value $1/\alpha_2$ and the hue correction value CV of the chunk, the chunk $1/\alpha_3$ calculating unit 96 calculates the chunk index value $1/\alpha_3$. The chunk index value $1/\alpha_3$ is an index used to calculate the irradiation amount of light output from the light source unit 60 to the pixels 48 constituting the chunk. Therefore, the chunk index value $1/\alpha_3$ corresponds to the chunk tentative index value $1/\alpha_2$. In a case where the chunk index value $1/\alpha_3$ is equal to the chunk tentative index value $1/\alpha_2$, and the light source unit 60 outputs light based on the values, the light source unit 60 outputs the same amount of light.

As described above, the chunk index value $1/\alpha_3$ is calculated based on the chunk tentative index value $1/\alpha_2$ and on the tentative index value $1/\alpha_1$ of each pixel 48. The chunk index value $1/\alpha_3$ is an index value used to calculate the irradiation amount of light from the light source unit 60.

The low-saturation pixel detecting unit 74 acquires the information on the saturation of the pixels 48 included in the target image display region 41 from the tentative $\alpha_1$ calculating unit 71 to detect low-saturation pixels 48L in the target image display region 41. The low-saturation pixels 48L have saturation, which is calculated based on the input signals, lower than a certain saturation value. The low-saturation pixels 48L will be described later in detail. The low-saturation pixel detecting unit 74 may calculate the saturation of the pixels 48 in the target image display region 41 based on the input signals.

The low-saturation pixel number determining unit 75 acquires the information on the low-saturation pixels 48L in the target image display region 41 from the low-saturation pixel detecting unit 74. The low-saturation pixel number determining unit 75 determines whether the number of low-saturation pixels 48L in the target image display region 41 is larger than a certain threshold. Because the certain threshold varies depending on external factors, such as a use environment, the threshold may be optionally set based on the external factors, for example.

The display quality maintenance reference value calculating unit 76 acquires the information on the low-saturation pixels 48L in the target image display region 41 from the low-saturation pixel detecting unit 74. The display quality maintenance reference value calculating unit 76 also acquires the information on the tentative index values $1/\alpha_1$ of the pixels 48 in the target image display region 41 from the tentative $1/\alpha_1$ calculating unit 72. Based on the information on the low-saturation pixels 48L and the information on the tentative index values $1/\alpha_1$, the display quality maintenance reference value calculating unit 76 calculates a display quality maintenance reference value. The display quality maintenance reference value is a reference value at which the display quality of the colors displayed by the low-saturation pixels 48L is maintained. More specifically, the display quality maintenance reference value is calculated or acquired by the signal processing unit 20 as a value at which the display quality of the colors displayed by the low-saturation pixels 48L is maintained when the irradiation amount of light from the light source unit 60 is equal to or larger than the display quality maintenance reference value. In other words, the display quality maintenance reference value may be calculated by the signal processing unit 20 or may be acquired as a set value.

The region tentative $1/\alpha_4$ calculating unit 77 acquires the information on the tentative index values $1/\alpha_1$ of the pixels 48 in the target image display region 41 to calculate a region tentative index value $1/\alpha_4$ common to all the pixels 48 in the target image display region 41. The region tentative index value $1/\alpha_4$ is an index used to calculate the irradiation amount of light output from the light source unit 60 to the target image display region 41. The region tentative index value $1/\alpha_4$ corresponds to the tentative index value $1/\alpha_1$. In a case where the region tentative index value $1/\alpha_4$ is equal to the tentative index value $1/\alpha_1$, and the light source unit 60 outputs light based on the values, the light source unit 60 outputs the same amount of light. The method for calculating the region tentative index value $1/\alpha_4$ performed by the region tentative $1/\alpha_4$ calculating unit 77 will be described later.

The light irradiation amount calculating unit 78 calculates a comparative light irradiation amount $1/\alpha_5$ based on the chunk index value $1/\alpha_3$, the result of determination of the low-saturation pixel number determining unit 75, and the display quality maintenance reference value. Based on the comparative light irradiation amount $1/\alpha_5$, the light irradiation amount calculating unit 78 calculates a light irradiation amount $1/\alpha_5$. The comparative light irradiation amount $1/\alpha_5$ is an index used to calculate the irradiation amount of light output from the light source unit 60 to the target image display region 41. The light irradiation amount $1/\alpha_6$ is a value indicating the irradiation amount of light output from the light source unit 60 to the target image display region 41. The comparative light irradiation amount $1/\alpha_5$ and the light irradiation amount $1/\alpha_6$ correspond to the tentative index value $1/\alpha_1$. In a case where the comparative light irradiation amount $1/\alpha_5$ is equal to the tentative index value $1/\alpha_1$, and the light source unit 60 outputs light based on the values, the light source unit 60 outputs the same amount of light. Similarly to this, in a case where the light irradiation amount $1/\alpha_6$ is equal to the tentative index value $1/\alpha_1$, and the light source unit 60 outputs light based on the values, the light source unit 60 outputs the same amount of light.

The light irradiation amount calculating unit 78 includes a comparative $1/\alpha_5$ unit 97 and a $1/\alpha_6$ determining unit 98. The comparative $1/\alpha_5$ unit 97 acquires, from the low-saturation pixel number determining unit 75, the result of determination of whether the number of low-saturation pixels 48L in the target image display region 41 is larger than the certain threshold. The comparative $1/\alpha_5$ unit 97 also acquires the information on the chunk index value $1/\alpha_3$ from the chunk $1/\alpha_3$ calculating unit 96. The comparative $1/\alpha_5$ unit 97 also acquires the information on the display quality maintenance reference value from the display quality maintenance reference value calculating unit 76. Based on the result of determination made by the low-saturation pixel number determining unit 75, the chunk index value $1/\alpha_3$, and the display quality maintenance reference value, the comparative $1/\alpha_5$ unit 97 calculates the comparative light irradiation amount $1/\alpha_5$ in the target image display region 41. More specifically, if the number of low-saturation pixels 48L is larger than the certain threshold, the comparative $1/\alpha_5$ unit 97 determines a larger one of the chunk index value $1/\alpha_3$ and the display quality maintenance reference value (one having a larger irradiation amount of light from the light source unit 60) to be the comparative light irradiation amount $1/\alpha_5$. If the number of low-saturation pixels 48L is equal to or smaller than the certain threshold, the comparative $1/\alpha_5$ unit 97 determines the chunk index value $1/\alpha_3$ to be the comparative light irradiation amount $1/\alpha_5$.

The $1/\alpha_6$ determining unit 98 acquires the information on the region tentative index value $1/\alpha_4$ in the target image display region 41 from the region tentative $1/\alpha_4$ calculating unit 77. The $1/\alpha_6$ determining unit 98 also acquires the information on the comparative light irradiation amount $1/\alpha_5$ in the target image display region 41 from the comparative $1/\alpha_5$ unit 97. Based on the region tentative index value $1/\alpha_4$ and the comparative light irradiation amount $1/\alpha_5$ in the target image display region 41, the $1/\alpha_6$ determining unit 98 calculates the light irradiation amount $1/\alpha_6$ in the target image display region 41. More specifically, the $1/\alpha_6$ determining unit 98 determines a larger one of the region tentative index value $1/\alpha_4$ and the comparative light irradiation amount $1/\alpha_5$ (one having a larger irradiation amount of light from the light source unit 60) to be the light irradiation amount $1/\alpha_6$ in the target image display region 41.

The $1/\alpha_6$ determining unit 98 outputs the information on the calculated light irradiation amount $1/\alpha_6$ in the target image display region 41 to the light source driving unit 50 as the light source control signal SBL. The light source driving unit 50 performs control such that the irradiation amount of light from the sidelight light source 62 that outputs light to the target image display region 41 corresponds to the light irradiation amount $1/\alpha_6$.

The $\alpha_6$ calculating unit 79 acquires the information on the light irradiation amount $1/\alpha_5$ from the $1/\alpha_6$ determining unit 98. Based on the light irradiation amount $1/\alpha_5$, the $\alpha_6$ calculating unit 79 calculates an expansion coefficient $\alpha_6$ used to expand the input signals corresponding to the respective pixels 48 in the target image display region 41. The expansion coefficient $\alpha_6$ is the reciprocal of the light irradiation amount $1/\alpha_6$. The expansion coefficient $\alpha_6$ is common to all the pixels 48 in the target image display region 41.

The output signal generating unit 80 acquires the information on the expansion coefficient $\alpha_6$ from the $\alpha_6$ calculating unit 79. Based on the expansion coefficient $\alpha_6$ and the input signals, the output signal generating unit 80 generates output signals for causing the pixels 48 in the target image display region 41 to display certain colors. The output signal generating unit 80 outputs the generated output signals to the image display panel driving unit 30. The method for generating the output signals performed by the output signal generating unit 80 will be described later.

Processing Operations of the Display Device

Calculation of the Tentative Index Value

Figure 6:
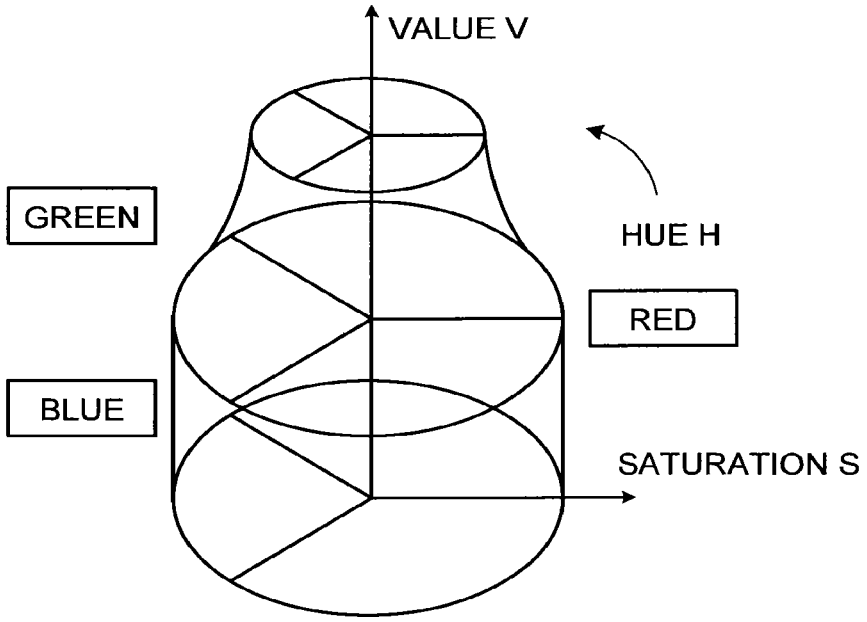
FIG. 6 is a conceptual diagram of an extended HSV color space extendable by the display device according to the present embodiment.
Figure 7:
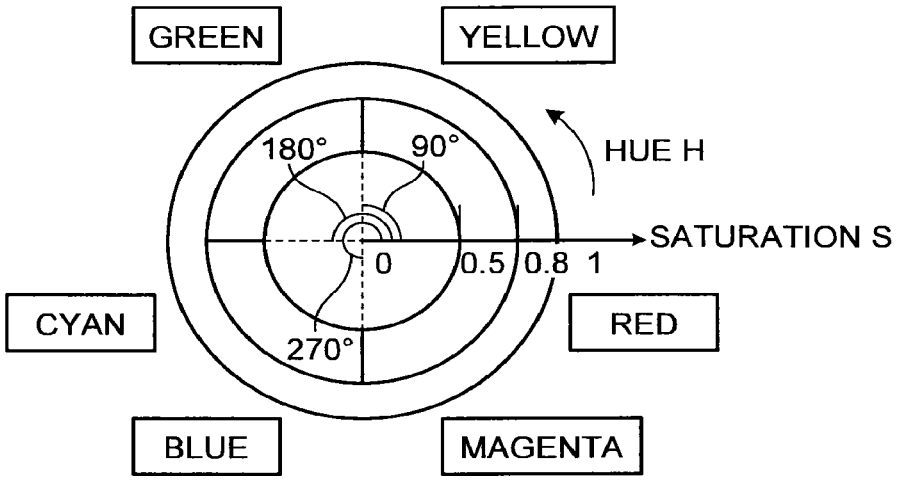
FIG. 7 is a conceptual diagram of a relation between the hue and the saturation in the extended HSV color space.

The following describes calculation of the tentative index value $1/\alpha_1$ out of the processing operations performed by the display device 10. The tentative index value $1/\alpha_1$ is calculated based on the tentative expansion coefficient $\alpha_1$ as described above. FIG. 6 is a conceptual diagram of an extended HSV color space extendable by the display device according to the present embodiment. FIG. 7 is a conceptual diagram of the relation between the hue and the saturation in the extended HSV color space.

In the display device 10, the pixels 48 each include the fourth sub-pixel 49W that outputs the fourth color (white) to broaden the dynamic range of brightness in the extended color space (HSV color space in the first embodiment) as illustrated in FIG. 6. Specifically, the expanded color space extended by the display device 10 has the shape illustrated in FIG. 6: a solid having a substantially truncated-cone-shaped section along the saturation axis and the brightness axis with curved oblique sides is placed on a cylindrical color space displayable by the first sub-pixel 49R, the second sub-pixel 49G, and the third sub-pixel 49B. The curved oblique sides indicate that the maximum value of the brightness decreases as the saturation increases. The signal processing unit 20 stores therein the maximum value Vmax (S) of the brightness in the expanded color space (HSV color space in the first embodiment) expanded by adding the fourth color (white). The variable of the maximum value Vmax(S) is saturation S. In other words, the signal processing unit 20 stores therein the maximum value Vmax(S) of the brightness for each pair of coordinates (values) of the saturation and the hue in the three-dimensional expanded color space illustrated in FIG. 6. Because the input signal includes input signals for the first sub-pixel 49R, the second sub-pixel 49G, and the third sub-pixel 49B, the color space of the input signal has a cylindrical shape, that is, the same shape as the cylindrical part of the expanded color space.

The tentative expansion coefficient $\alpha_1$ is a tentative value used to expand the input signal and convert the color space extended by the output signal into the expanded color space. Based on the input signal values for the sub-pixels 49 in the pixels 48 included in the target image display region 41, the tentative $\alpha_1$ calculating unit 71 of the signal processing unit 20 calculates the saturation S and value V(S) of the pixels 48 to calculate the tentative expansion coefficient $\alpha_1$.

The saturation S and the value V(S) are expressed as follows: S=(Max−Min)/Max, and V(S)=Max. The saturation S can take values of 0 to 1, and the value V(S) can take values of 0 to $(2^n-1)$ where n is the number of bits of display gradation. Max is the maximum value of the input signal values for the three sub-pixels in a pixel, that is, of the input signal value for the first sub-pixel 49R, the input signal value for the second sub-pixel 49G, and the input signal value for the third sub-pixel 49B. Min is the minimum value of the input signal values for the three sub-pixels in the pixel, that is, of the input signal value for the first sub-pixel 49R, the input signal value for the second sub-pixel 49G, and the input signal value for the third sub-pixel 49B. As illustrated in FIG. 7, the hue H is represented in the range from 0° to 360°. The hue H varies in order of red, yellow, green, cyan, blue, magenta, and red from 0° to 360°.

The signal processing unit 20 receives the input signal, which is information of the image to be displayed, input from the control device 11. The input signal includes the information of the image (color) to be displayed at its position for each pixel as the input signal. Specifically, with respect to the (p,q)-th pixel (where $1 \le p \le I$, $1 \le q \le Q_0$), the signal processing unit 20 receives a signal input thereto including an input signal of the first sub-pixel the signal value of which is $x_{1-(p,q)}$, an input signal of the second sub-pixel the signal value of which is $x_{2-(p,q)}$, and an input signal of the third sub-pixel the signal value of which is $x_{3-(p,q)}$.

In the (p,q)-th pixel, the saturation $S_{(p,q)}$ and the value $V(S)_{(p,q)}$ of the input color in the cylindrical HSV color space are generally calculated by Equations (1) and (2) based on the input signal for the first sub-pixel (signal value $x_{1-(p,q)}$), the input signal for the second sub-pixel (signal value $x_{2-(p,q)}$), and the input signal for the third sub-pixel (signal value $x_{3-(p,q)}$).

$$S_{(p,q)}=(\mathrm{Max}_{(p,q)}-\mathrm{Min}_{(p,q)})/\mathrm{Max}_{(p,q)} \tag{1}$$

$$V(S)_{(p,q)}=\mathrm{Max}_{(p,q)} \tag{2}$$

In these Equations, $\mathrm{Max}_{(p,q)}$ is the maximum value among the input signal values of three sub-pixels 49, that is, ($x_{1-(p,q)}$, $x_{2-(p,q)}$, and $x_{3-(p,q)}$), and $\mathrm{Min}_{(p,q)}$ is the minimum value of the input signal values of three sub-pixels 49, that is ($x_{1-(p,q)}$, $x_{2-(p,q)}$, and $x_{3-(p,q)}$). In the first embodiment, n is 8. That is, the display gradation bit number is 8 bits (a value of the display gradation is 256 gradations, that is, 0 to 255).

The signal processing unit 20 calculates the tentative expansion coefficient $\alpha_1$ using Equation (3) based on the value $V(S)_{(p,q)}$ of each pixel 48 in the target image display region 41 and Vmax(S) of the expanded color space. The tentative expansion coefficient $\alpha_1$ may possibly vary depending on the pixel 48.

$$\alpha_{1(p,q)}=V\mathrm{max}(S)/V(S)_{(p,q)} \tag{3}$$

The tentative $\alpha_1$ calculating unit 71 of the signal processing unit 20 calculates the hue of the (p,q)-th pixel 48 using Equation (4).

$$H=\begin{cases} \text{undefined}, & \text{if } \mathrm{Min}_{(p,q)}=\mathrm{Max}_{(p,q)} \\ 60\times\dfrac{x_{2-(p,q)}-x_{1-(p,q)}}{\mathrm{Max}_{(p,q)}-\mathrm{Min}_{(p,q)}}+60, & \text{if } \mathrm{Min}_{(p,q)}=x_{3-(p,q)} \\ 60\times\dfrac{x_{3-(p,q)}-x_{2-(p,q)}}{\mathrm{Max}_{(p,q)}-\mathrm{Min}_{(p,q)}}+180, & \text{if } \mathrm{Min}_{(p,q)}=x_{1-(p,q)} \\ 60\times\dfrac{x_{1-(p,q)}-x_{3-(p,q)}}{\mathrm{Max}_{(p,q)}-\mathrm{Min}_{(p,q)}}+300, & \text{if } \mathrm{Min}_{(p,q)}=x_{2-(p,q)} \end{cases} \tag{4}$$

The tentative $1/\alpha_1$ calculating unit 72 of the signal processing unit 20 calculates the reciprocal of $\alpha_{1(p,q)}$ and determines the calculated reciprocal of as a tentative index value $1/\alpha_{1(p,q)}$ of the (p,q)-th pixel 48. Thus, the signal processing unit 20 calculates the tentative index value $1/\alpha_1$ of each pixel 48.

Calculation of the Chunk Index Value

Figure 8:
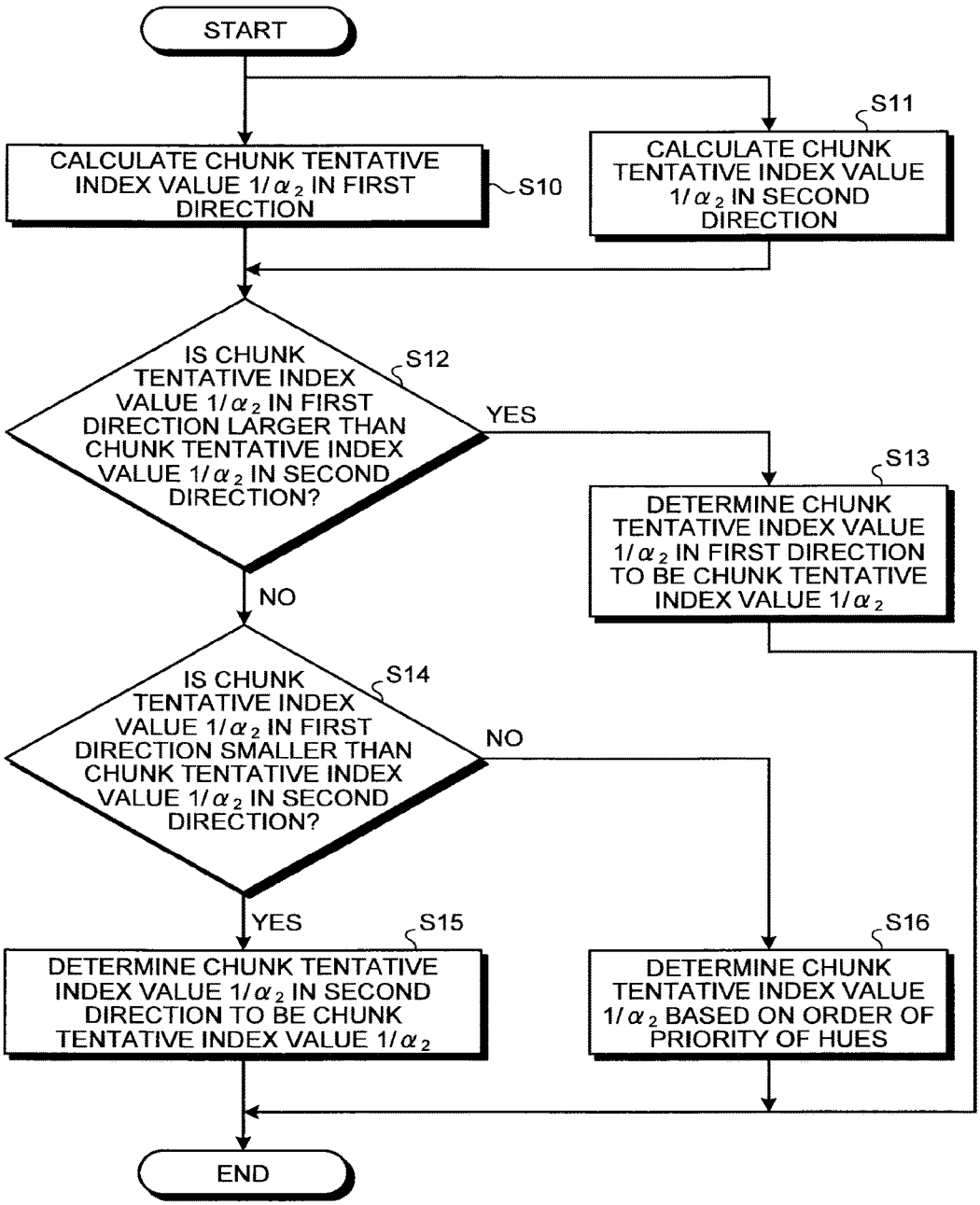
FIG. 8 is a flowchart for explaining calculation of a chunk tentative index value.

The following describes calculation of the chunk index value $1/\alpha_3$ out of the processing operations performed by the display device 10. The explanation starts with calculation of the chunk tentative index value $1/\alpha_2$ performed by the chunk tentative $1/\alpha_2$ calculating unit 92. FIG. 8 is a flowchart for explaining calculation of the chunk tentative index value.

The chunk tentative $1/\alpha_2$ calculating unit 92 calculates in parallel the chunk tentative index value $1/\alpha_2$ in the first direction in the target image display region 41 (Step S10) and the chunk tentative index value $1/\alpha_2$ in the second direction in the target image display region 41 (Step S11)

based on the tentative index value $1/\alpha_1$ of the pixel 48. The processing at Step S10 and Step S11 will be described later. The processing at Step S10 and at Step S11 may be performed in parallel or in order. The first direction is a direction in which a writing position moves when an image is written in the image display panel 40. In other words, the first direction is a movement direction of a pixel for which a signal is processed in processing of data. The second direction is orthogonal to the first direction.

After calculating the chunk tentative index value $1/\alpha_2$ in the first direction and the second direction, the chunk tentative $1/\alpha_2$ calculating unit 92 determines whether the chunk tentative index value $1/\alpha_2$ in the first direction is larger than that in the second direction (Step S12). If the chunk tentative $1/\alpha_2$ calculating unit 92 determines that the chunk tentative index value $1/\alpha_2$ in the first direction is larger than that in the second direction (Yes at Step S12), the chunk tentative $1/\alpha_2$ calculating unit 92 determines the chunk tentative index value $1/\alpha_2$ in the first direction to be the chunk tentative index value $1/\alpha_2$ in the target image display region 41 (Step S13). The present processing is then finished. If the chunk tentative $1/\alpha_2$ calculating unit 92 determines that the chunk tentative index value $1/\alpha_2$ in the first direction is not larger than that in the second direction (No at Step S12), that is, that the chunk tentative index value $1/\alpha_2$ in the first direction is equal to or smaller than that in the second direction, the chunk tentative $1/\alpha_2$ calculating unit 92 determines whether the chunk tentative index value $1/\alpha_2$ in the first direction is smaller than that in the second direction (Step S14).

If the chunk tentative $1/\alpha_2$ calculating unit 92 determines that the chunk tentative index value $1/\alpha_2$ in the first direction is smaller than that in the second direction (Yes at Step S14), the chunk tentative $1/\alpha_2$ calculating unit 92 determines the chunk tentative index value $1/\alpha_2$ in the second direction to be the chunk tentative index value $1/\alpha_2$ in the target image display region 41 (Step S15). The present processing is then finished. In other words, the chunk tentative $1/\alpha_2$ calculating unit 92 determines a larger one of the chunk tentative index value $1/\alpha_2$ in the first direction and that in the second direction to be the chunk tentative index value $1/\alpha_2$. If the chunk tentative $1/\alpha_2$ calculating unit 92 determines that the chunk tentative index value $1/\alpha_2$ in the first direction is not smaller than that in the second direction (No at Step S14), that is, that the chunk tentative index value $1/\alpha_2$ in the first direction is equal to that in the second direction, the chunk tentative $1/\alpha_2$ calculating unit 92 determines the chunk tentative index value $1/\alpha_2$ in the target image display region 41 based on the order of priority of the hues (Step S16). The present processing is then finished. Specifically, the chunk tentative $1/\alpha_2$ calculating unit 92 determines the chunk tentative index value $1/\alpha_2$ having higher hue priority between the chunk tentative index value $1/\alpha_2$ in the first direction and that in the second direction to be the chunk tentative index value $1/\alpha_2$. The order of priority is: yellow, yellowish green, cyan, green, magenta, violet, red, and blue in descending order, for example.

Figure 9:
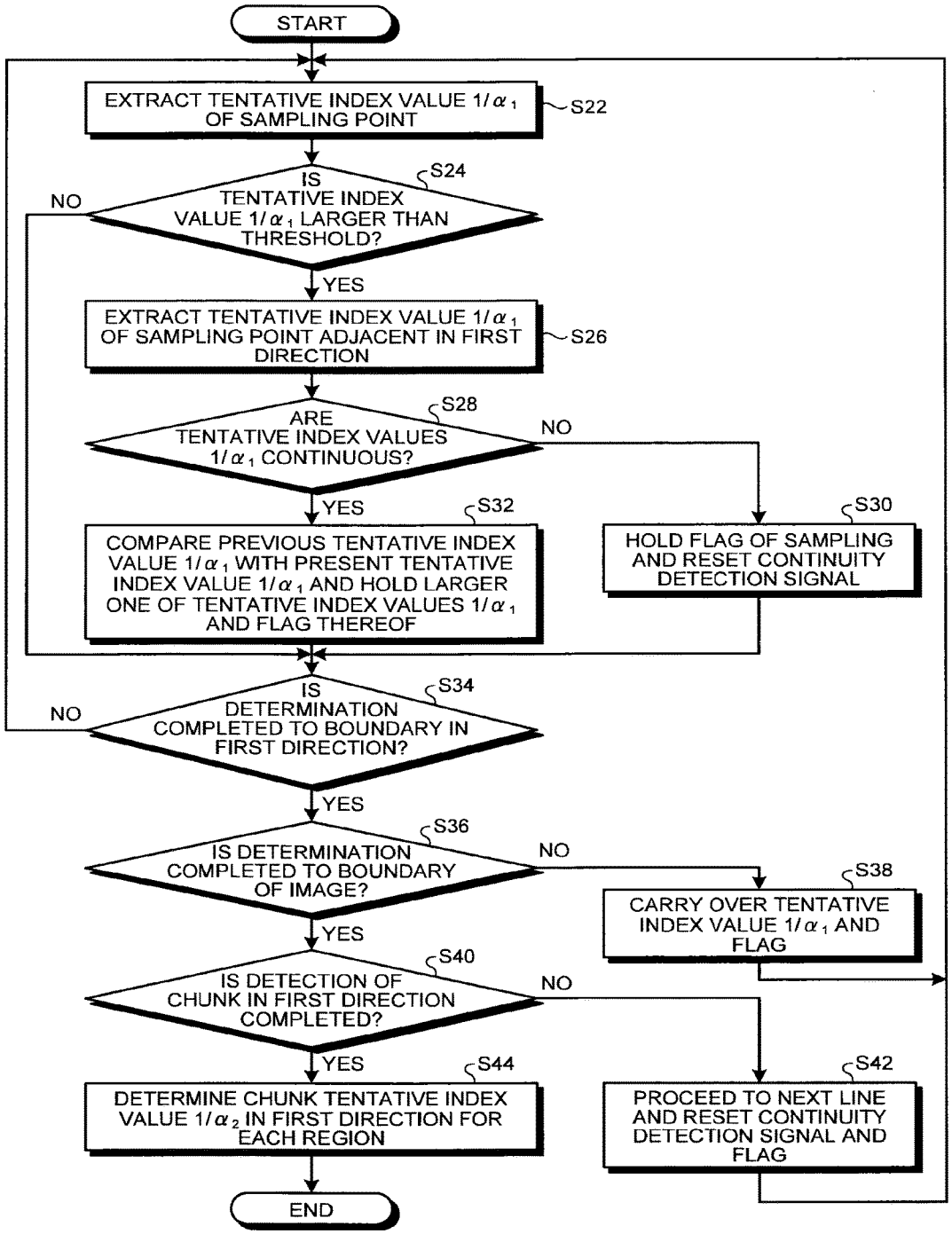
FIG. 9 is a flowchart for explaining calculation of the chunk tentative index value in a first direction.

FIG. 9 is a flowchart for explaining calculation of the chunk tentative index value in the first direction. The chunk tentative $1/\alpha_2$ calculating unit 92 according to the present embodiment performs an analysis using the tentative index values $1/\alpha_1$ of pixels of sampling points extracted from all the pixels 48 in the image display panel 40. Thus, the chunk tentative $1/\alpha_2$ calculating unit 92 determines the chunk tentative index value $1/\alpha_2$ in the first direction. By performing the analysis on the pixels of the sampling points, it is possible to reduce arithmetic processing. The sampling points are preferably provided at certain pixel intervals. The sampling points may be deviated from one another or overlap with one another in chunk detection between the first direction and the second direction.

The chunk tentative $1/\alpha_2$ calculating unit 92 extracts the tentative index value $1/\alpha_1$ of a first sampling point (Step S22) and determines whether the tentative index value $1/\alpha_1$ is larger than a threshold (Step S24). The threshold is a reference used to determine whether the tentative index value $1/\alpha_1$ falls within a range in which detection of a chunk need not be considered (the adjustment according to the present embodiment need not be performed) and is 8'h40, for example. If the chunk tentative $1/\alpha_2$ calculating unit 92 determines that the tentative index value $1/\alpha_1$ is equal to or smaller than the threshold (No at Step S24), the chunk tentative $1/\alpha_2$ calculating unit 92 performs processing at Step S34.

By contrast, if the chunk tentative $1/\alpha_2$ calculating unit 92 determines that the tentative index value $1/\alpha_1$ is larger than the threshold (Yes at Step S24), the chunk tentative $1/\alpha_2$ calculating unit 92 extracts the tentative index value $1/\alpha_1$ of a second sampling point adjacent in the first direction (Step S26). The chunk tentative $1/\alpha_2$ calculating unit 92 determines whether the tentative index values $1/\alpha_1$ are continuous (Step S28). The chunk tentative $1/\alpha_2$ calculating unit 92 classifies the tentative index values $1/\alpha_1$ by a plurality of ranges. If the tentative index value $1/\alpha_1$ of the second sampling point used for comparison falls within the same range as that of the first sampling point out of the ranges resulting from the classification, the chunk tentative $1/\alpha_2$ calculating unit 92 determines that the tentative index values $1/\alpha_1$ are continuous. The number and the magnitude of the ranges in the classification may be optionally set. The chunk tentative $1/\alpha_2$ calculating unit 92 may determine whether the tentative index values $1/\alpha_1$ are continuous based on whether the tentative index values $1/\alpha_1$ are identical to each other. Alternatively, if the tentative index value $1/\alpha_1$ of the first sampling point falls within the range of the tentative index value $1/\alpha_1$ used for comparison or falls within a range larger than it, the chunk tentative $1/\alpha_2$ calculating unit 92 may determine that the tentative index values $1/\alpha_1$ are continuous. Still alternatively, if tentative index values $1/\alpha_1$ of sampling points of equal to or larger than a preset number, that is, of two or more sampling points are continuous, the chunk tentative $1/\alpha_2$ calculating unit 92 may determine that the tentative index values $1/\alpha_1$ are continuous.

If the chunk tentative $1/\alpha_2$ calculating unit 92 determines that the tentative index values $1/\alpha_1$ are not continuous (No at Step S28), the chunk tentative $1/\alpha_2$ calculating unit 92 holds a flag of sampling and resets a continuity detection signal (Step S30). Subsequently, the chunk tentative $1/\alpha_2$ calculating unit 92 performs the processing at Step S34. The continuity detection signal is turned ON while the sampling points are continuous. If the chunk tentative $1/\alpha_2$ calculating unit 92 determines that the tentative index values $1/\alpha_1$ are continuous (Yes at Step S28), the chunk tentative $1/\alpha_2$ calculating unit 92 compares the previous tentative index value $1/\alpha_1$ with the present tentative index value $1/\alpha_1$. The chunk tentative $1/\alpha_2$ calculating unit 92 holds a larger one of the tentative index values $1/\alpha_1$ and the flag thereof (Step S32) and then performs the processing at Step S34.

After making the determination of the sampling point, the chunk tentative $1/\alpha_2$ calculating unit 92 determines whether the determination is completed to a boundary of the image display region 41 in the first direction (Step S34). If the chunk tentative $1/\alpha_2$ calculating unit 92 determines that the determination is not completed to the boundary of the image display region 41 in the first direction (No at Step S34), the chunk tentative $1/\alpha_2$ calculating unit 92 performs the processing at Step S22 again to perform the processing described above on another sampling point. As described above, the chunk tentative $1/\alpha_2$ calculating unit 92 repeatedly performs the processing until the determination is completed to the boundary of the image display region 41 in the first direction. If the chunk tentative $1/\alpha_2$ calculating unit 92 determines that the determination is completed to the boundary of the image display region 41 in the first direction (Yes at Step S34), the chunk tentative $1/\alpha_2$ calculating unit 92 determines whether the determination is completed to a boundary of the image, that is, the pixel 48 at the end of the image display panel 40 (Step S36).

If the chunk tentative $1/\alpha_2$ calculating unit 92 determines that the determination is not completed to the boundary of the image (No at Step S36), the chunk tentative $1/\alpha_2$ calculating unit 92 carries over the tentative index value $1/\alpha_1$ and the flag (Step S38) and then performs the processing at Step S22 again. If the chunk tentative $1/\alpha_2$ calculating unit 92 determines that the determination is completed to the boundary of the image (Yes at Step S36), the chunk tentative $1/\alpha_2$ calculating unit 92 determines whether the detection of a chunk in the first direction is completed, that is, whether the processing is performed on the sampling points on the entire image (Step S40).

If the chunk tentative $1/\alpha_2$ calculating unit 92 determines that the detection of a chunk in the first direction is not completed (No at Step S40), the chunk tentative $1/\alpha_2$ calculating unit 92 proceeds to the next line and resets the continuity detection signal and the flag (Step S42). Subsequently, the chunk tentative $1/\alpha_2$ calculating unit 92 performs the processing at Step S22 again. If the chunk tentative $1/\alpha_2$ calculating unit 92 determines that the detection of a chunk in the first direction is completed (Yes at Step S40), the chunk tentative $1/\alpha_2$ calculating unit 92 determines the chunk tentative index value $1/\alpha_2$ in the first direction for each image display region 41 (Step S44). The present processing is then finished.

Figure 10:
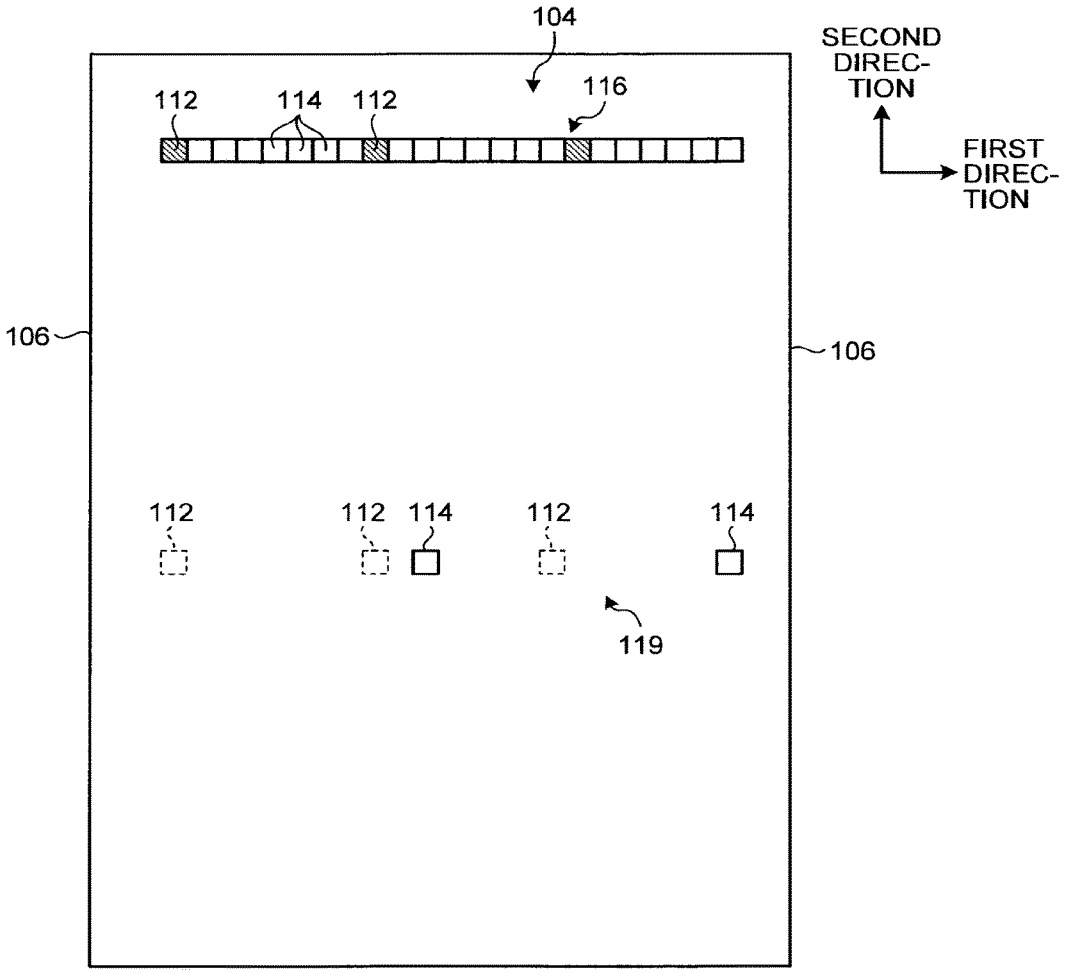
FIG. 10 is a diagram for explaining an operation of calculating the chunk tentative index value in the first direction.
Figure 11:
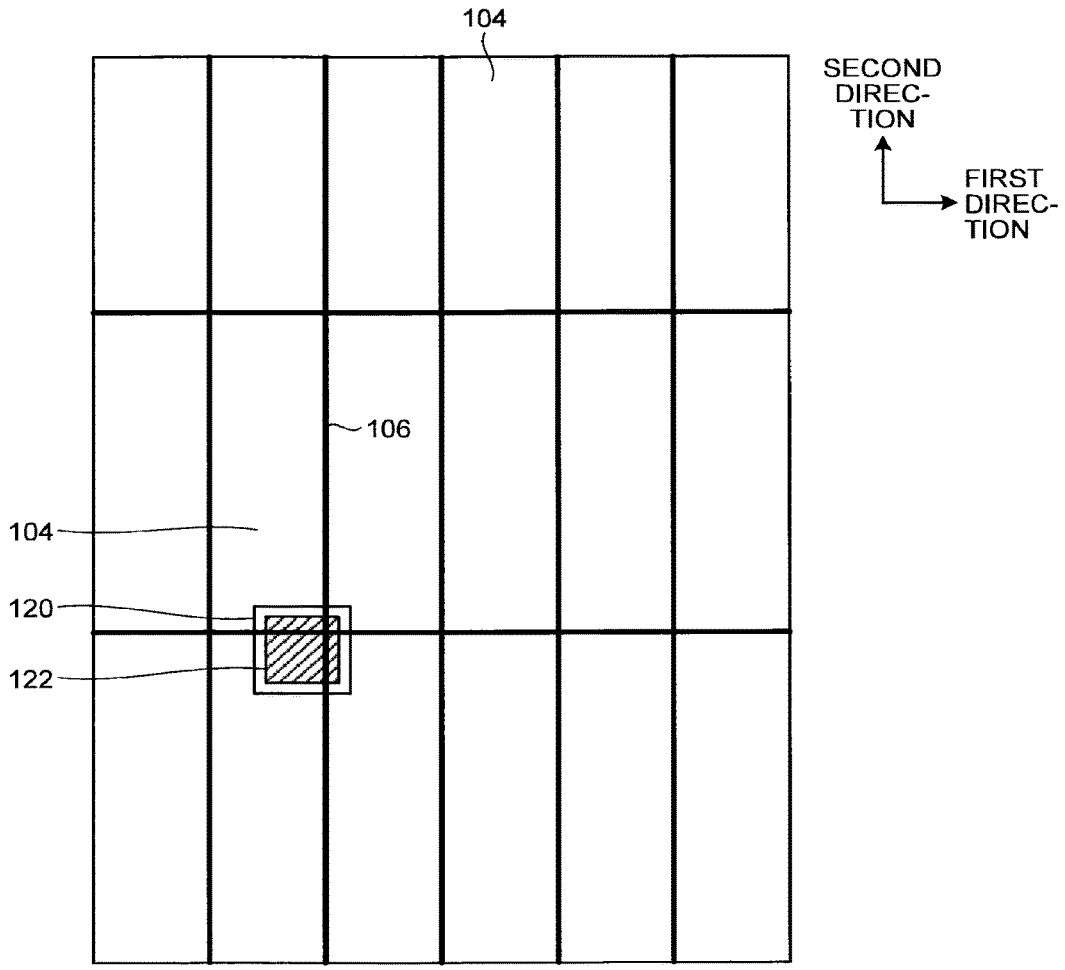
FIG. 11 is another diagram for explaining the operation of calculating the chunk tentative index value in the first direction.
Figure 12:
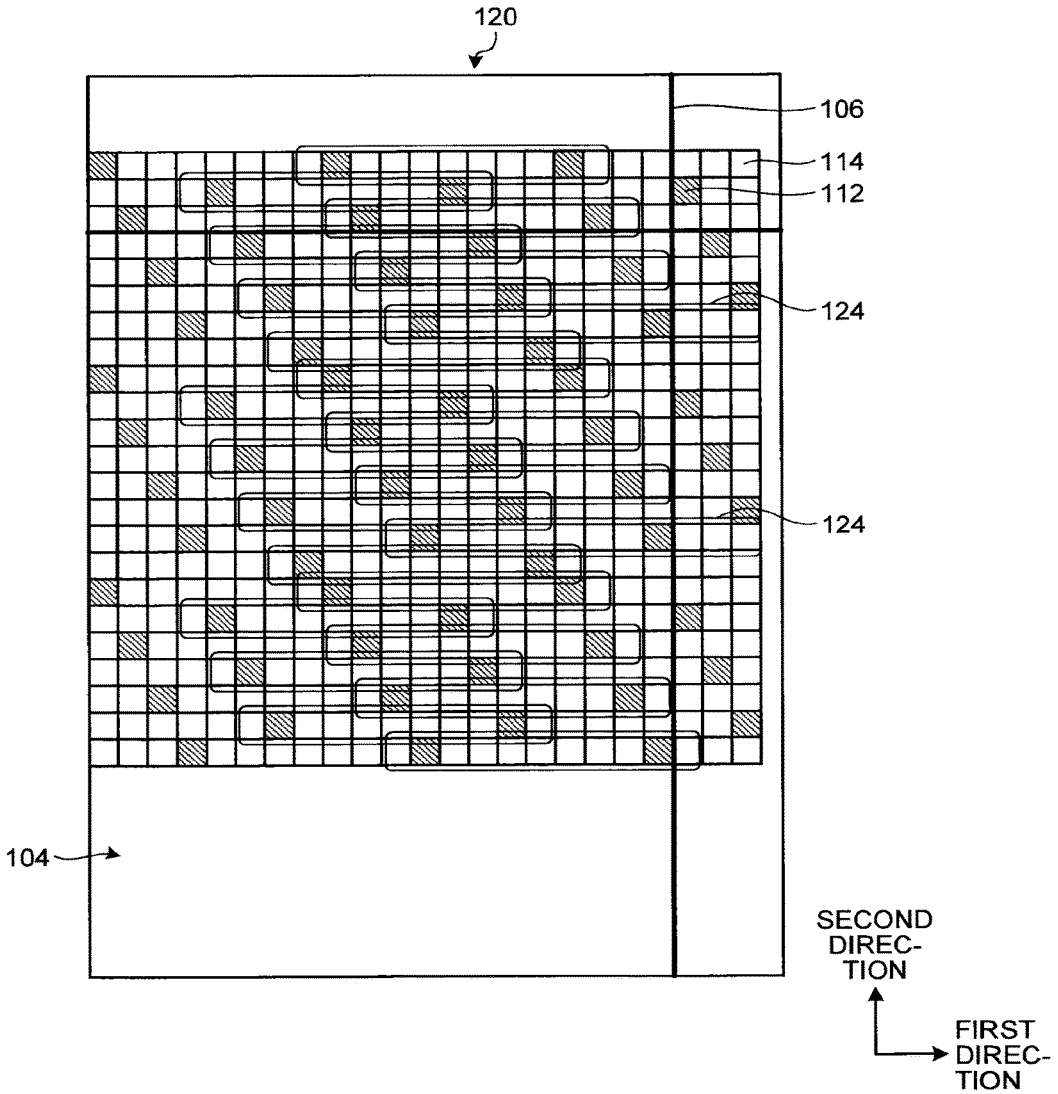
FIG. 12 is still another diagram for explaining the operation of calculating the chunk tentative index value in the first direction.

FIGS. 10 to 12 are diagrams for explaining an operation of calculating the chunk tentative index value in the first direction. By performing the processing illustrated in FIG. 9, the chunk tentative $1/\alpha_2$ calculating unit 92 can determine, to be a chunk, a region 116 in which pixels 114 having higher tentative index value $1/\alpha_1$ are continuous in the first direction as illustrated in FIG. 10. Specifically, the chunk tentative $1/\alpha_2$ calculating unit 92 determines the tentative index values $1/\alpha_1$ of sampling points 112 in the region 116 to be continuous, thereby determining the region 116 to be a chunk. The pixels 114 having higher tentative index values $1/\alpha_1$ are pixels that display an image having higher saturation, that is, pixels of primary colors, such as yellow, green, and red, or pixels having higher gradations for two-color components out of the three colors of RGB and a gradation of approximately 0 for the remaining one component. By performing the processing illustrated in FIG. 9, the chunk tentative $1/\alpha_2$ calculating unit 92 determines that no chunk is present in a region 119 in which the pixels 114 having higher tentative index values $1/\alpha_1$ are not continuous in the first direction as illustrated in FIG. 10.

FIG. 11 illustrates a case where a chunk 112 composed of the pixels 114 having higher tentative index values $1/\alpha_1$ extends over a plurality of image display regions 104 surrounded by a range 120. FIG. 12 is an enlarged view of the range 120. The chunk tentative $1/\alpha_2$ calculating unit 92 performs the processing illustrated in FIG. 9 and carries over the tentative index value $1/\alpha_1$ and the flag after the determination is completed to the boundary in the first direction. In a case where the chunk 122 extends from the adjacent image display region 104 as illustrated in FIGS. 11 and 12, the chunk tentative $1/\alpha_2$ calculating unit 92 carries over the result of determination of the chunk in the first direction across a division line 106 as indicated by the solid line 124. Thus, the chunk tentative $1/\alpha_2$ calculating unit 92 can reliably detect the chunk in the adjacent image display region 104.

Because the method for calculating the chunk tentative index value $1/\alpha_2$ in the second direction is the same as that in the first direction, detailed explanation thereof with reference to a flowchart will be omitted.

Figure 13:
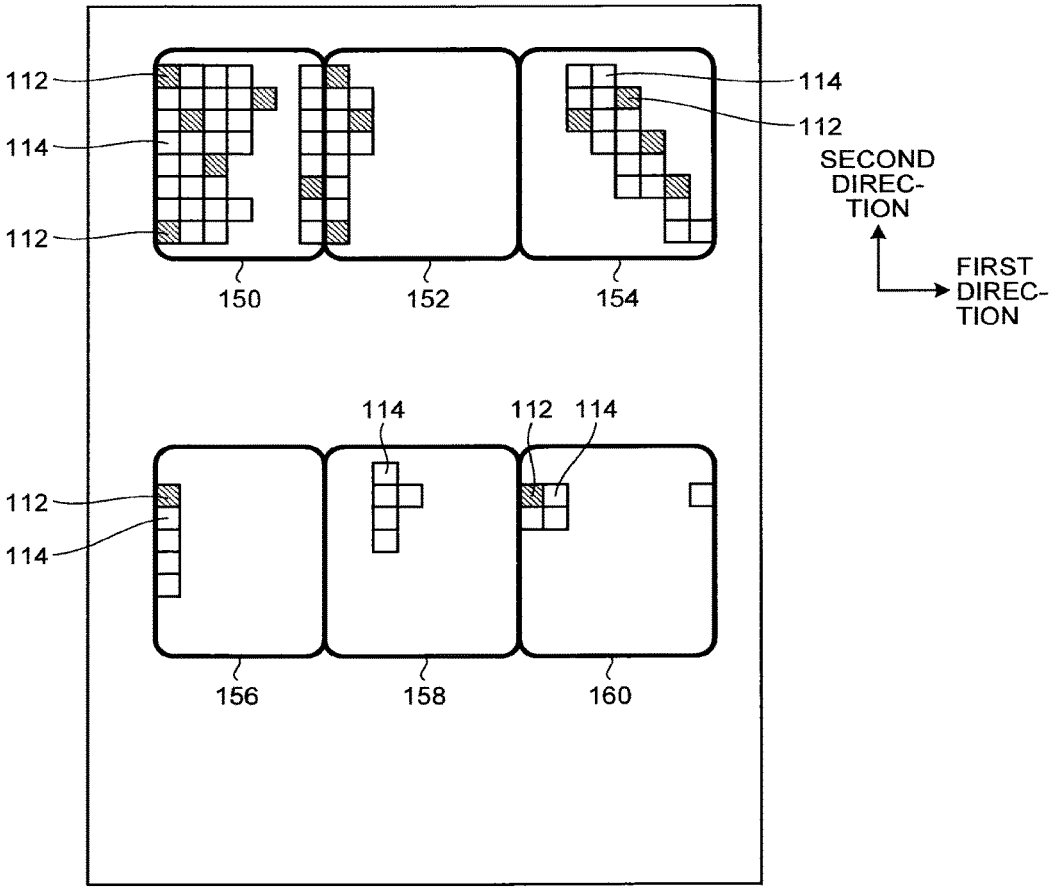
FIG. 13 is a diagram for explaining an operation of calculating the chunk tentative index value in a second direction.

FIG. 13 is a diagram for explaining an operation of calculating the chunk tentative index value in the second direction. By calculating the chunk tentative index value $1/\alpha_2$ in the second direction, the chunk tentative $1/\alpha_2$ calculating unit 92 can determine chunks in regions 150, 152, and 154 in which the pixels 114 having higher tentative index values $1/\alpha_1$ are continuous in the vertical direction to be chunks as illustrated in FIG. 13. By calculating the chunk tentative index value $1/\alpha_2$ in the second direction, the chunk tentative $1/\alpha_2$ calculating unit 92 can determine that no chunk is present in regions 156, 158, and 160 in which the pixels 114 having higher tentative index values $1/\alpha_1$ are not continuous in the second direction.

Figure 14A:
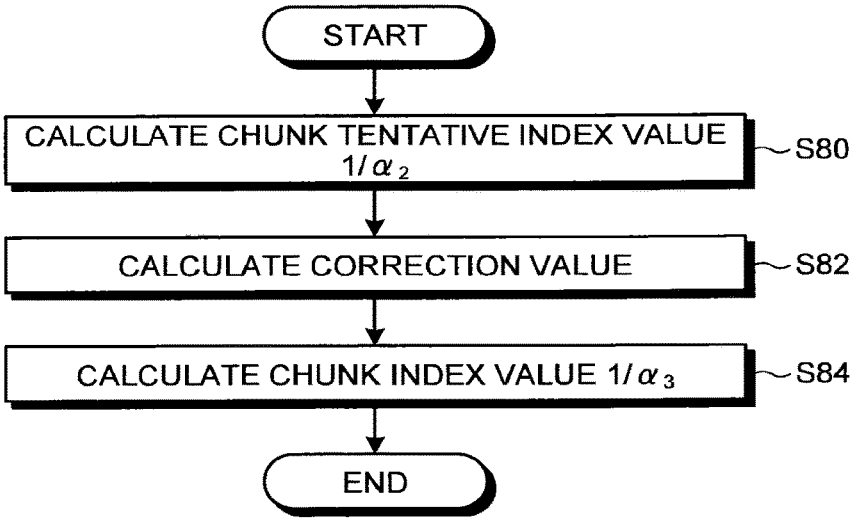
FIG. 14A is a flowchart for explaining calculation of the chunk index value.

The following describes calculation of the chunk index value $1/\alpha_3$. FIG. 14A is a flowchart for explaining the calculation of the chunk index value. As illustrated in FIG. 14A, to calculate the chunk index value $1/\alpha_3$, the chunk tentative $1/\alpha_2$ calculating unit 92 calculates the chunk tentative index value $1/\alpha_2$ first (Step S80). The processing at Step S80 corresponds to the processing described with reference to FIG. 8.

After calculating the chunk tentative index value $1/\alpha_2$, the correction value calculating unit 94 calculates a correction value (hue correction value CV in the present embodiment) (Step S82). The correction value calculating unit 94 acquires the information on the chunk detected by the chunk tentative $1/\alpha_2$ calculating unit 92 and the information on the hue of each pixel 48 to calculate the hues of the pixels 48 constituting the chunk. Based on the hues of the pixels 48 constituting the chunk, the correction value calculating unit 94 calculates the hue correction value CV.

Figure 14B:
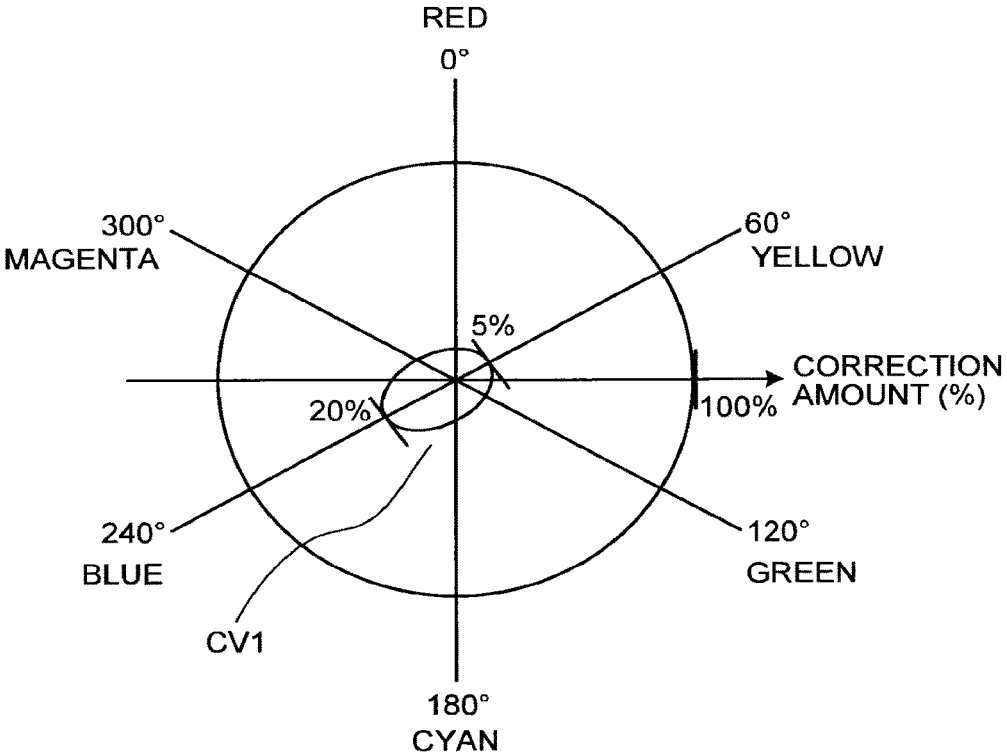
FIG. 14B is a diagram for explaining an example of calculation of a hue correction value.

The hue correction value CV is calculated based on the hues of the pixels 48 constituting the chunk. By correcting the chunk tentative index value $1/\alpha_2$ with the hue correction value CV, it is possible to reduce the irradiation amount of light output from the light source unit 60 based on the chunk tentative index value $1/\alpha_2$ while preventing deterioration in the image. FIG. 14B is a diagram for explaining an example of calculation of the hue correction value. In FIG. 14B, the circumferential direction indicates the hue, and the radial direction indicates the correction amount. The correction amount in FIG. 14B corresponds to the hue correction value CV. The maximum allowable value of the chunk tentative index value $1/\alpha_2$ is represented by 100%. The curve CV1 in FIG. 14B indicates the hue correction value CV of each hue. When the irradiation amount of light from a backlight is reduced, deterioration in an image is less likely to be recognized in the hue of blue and more likely to be recognized in the hue of yellow. As indicated by the curve CV1, the hue correction value CV varies at a certain ratio depending on the hue and increases in order of the hues of yellow (60°), green (120°), and blue (240°). The hue correction value CV also increases in order of the hues of yellow (60°), red (0°), and blue (240°). The hue correction value CV takes the minimum value of 5% for the hue of yellow (5% of the maximum allowable value of the chunk tentative index value $1/\alpha_2$). The hue correction value CV takes the maximum value of 20% for the hue of blue (20% of the maximum allowable value of the chunk tentative index value $1/\alpha_2$).

The hue correction value CV may be optionally set and is not limited to that indicated by the curve CV1 as long as it takes different values depending on the hue of the chunk. The hue correction value CV, for example, is preferably set to equal to or smaller than 5% of the maximum allowable value of the chunk tentative index value $1/\alpha_2$ in yellow (in a case where the hue is yellow), which is more sensitively recognized by human eyes and more sensitively identified in color difference determination using the CIE 2000 color difference formula. The hue correction value CV is preferably set to 10% to 20% of the maximum allowable value of the chunk tentative index value $1/\alpha_2$ in blue (in a case where the hue is blue), which is less sensitively recognized by human eyes and less sensitively identified in color difference determination using the CIE 2000 color difference formula. The hue correction value CV may discretely vary depending on the hue. In a case where the hue is classified into continuous angular ranges, for example, the hue correction values CV in the same angular range may be a fixed value, and the hue correction values CV in different angular ranges may be different values. Also in this case, the hue correction value preferably takes the maximum in an angular range including the hue of yellow (e.g., from 30° to 90°) and takes the minimum in an angular range including the hue of blue (e.g., from 210° to 270°).

After calculating the correction value (hue correction value CV in the present embodiment), the chunk $1/\alpha_3$ calculating unit 96 calculates the chunk index value $1/\alpha_3$ (Step S84). More specifically, the chunk $1/\alpha_3$ calculating unit 96 calculates a chunk index value $1/\alpha_{3A}$ of a certain chunk based on Equation (5) where $1/\alpha_{2A}$ denotes the chunk tentative index value of the certain chunk, and $CV_A$ denotes the hue correction value CV of the certain chunk. After the processing at Step S84 is performed, the calculation of the chunk index value $1/\alpha_3$ is finished.

$$1/\alpha_{3A}=1/\alpha_{2A}-CV_A \tag{5}$$

As expressed by Equation (5), the chunk index value $1/\alpha_3$ is obtained by subtracting the hue correction value $CV_A$ from the chunk tentative index value $1/\alpha_2$. The hue correction value CV is used to reduce the irradiation amount of light output to a chunk based on the hue of the chunk. In other words, the chunk index value $1/\alpha_3$ is obtained by subtracting the irradiation amount of light from the chunk tentative index value $1/\alpha_2$ based on the hue.

As described above, the signal processing unit 20 calculates the chunk index value $1/\alpha_3$ in the target image display region 41.

Detection of the Low-Saturation Pixel

The following describes detection of the low-saturation pixels 48L. The low-saturation pixel detecting unit 74 of the signal processing unit 20 acquires the information on the saturation of the pixels 48 included in the target image display region 41 to detect the low-saturation pixels 48L in the target image display region 41. The low-saturation pixel detecting unit 74 detects pixels 48 having saturation lower than a certain saturation value as the low-saturation pixels 48L.

Figure 15:
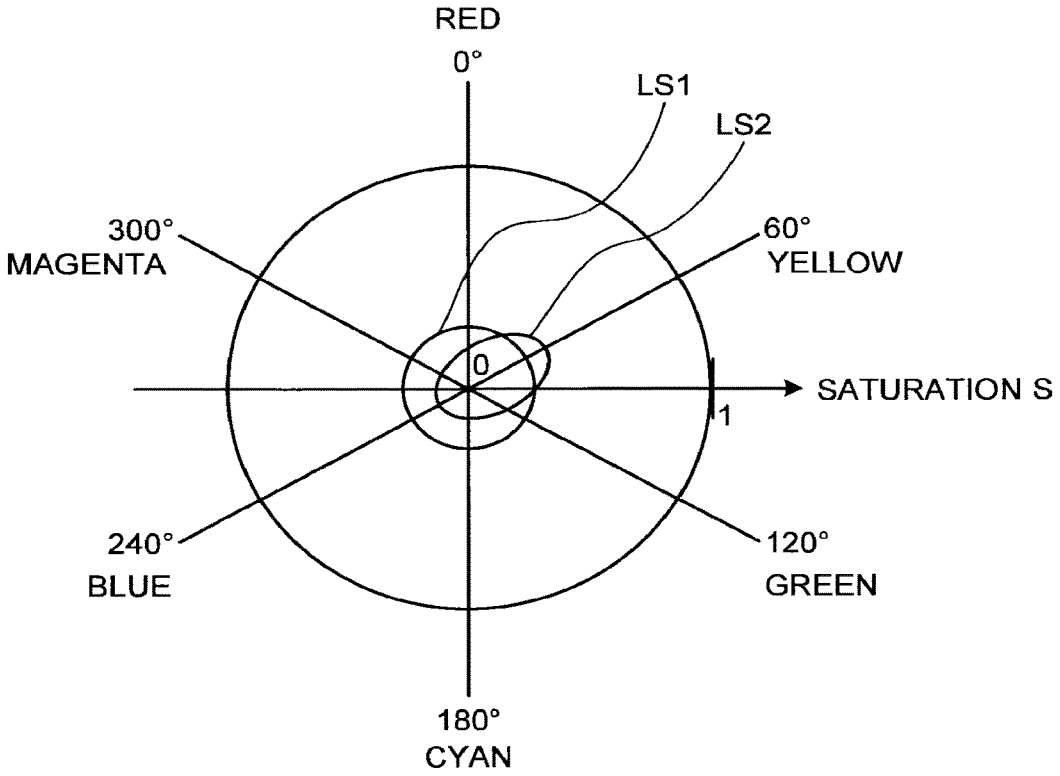
FIG. 15 is a diagram for explaining an example of detection of a low-saturation pixel.

FIG. 15 is a diagram for explaining an example of detection of the low-saturation pixel. In FIG. 15, the circumferential direction indicates the hue, and the radial direction indicates the saturation. The curve LS1 in FIG. 15 indicates an example of a region of saturation of the low-saturation pixel 48L. In other words, the curve LS1 indicates an example of the certain saturation value. If the saturation of a pixel 48 is lower than the saturation indicated by the curve LS1, the low-saturation pixel detecting unit 74 determines the pixel 48 to be the low-saturation pixel 48L. The curve LS1 is a circle the center of which is located at the center point of saturation 0. In this example, the certain saturation value is a fixed value independently of the hue. The curve LS2 in FIG. 15 indicates an another example of the region of saturation of the low-saturation pixel 48L. In other words, the curve LS2 indicates another example of the certain saturation value. If the saturation of a pixel 48 is lower than the saturation indicated by the curve LS2, the low-saturation pixel detecting unit 74 determines the pixel 48 to be the low-saturation pixel 48L. The curve LS2 is an ellipse the center of which is located at the center point of saturation 0. In the curve LS2, the major axis corresponds to the certain saturation value for the hue of yellow, whereas the minor axis corresponds to that for the hue of blue. In this another example, the certain saturation value varies depending on the hue. The certain saturation value takes the maximum for the hue of yellow and takes the minimum for the hue of blue. The certain saturation value for the hue of yellow is 0.4, whereas the certain saturation value for the hue of blue is 0.2, for example. As described above, the certain saturation value may be fixed independently of the hue or vary depending on the hue at a certain ratio. In a case where the hue is classified into continuous angular ranges, the certain saturation values in the same angular range may be a fixed value, and the certain saturation values in different angular ranges may be different values. Also in this case, the certain saturation value preferably takes the maximum in an angular range including the hue of yellow (e.g., from 30° to 90°) and takes the minimum in an angular range including the hue of blue (e.g., from 210° to 270°). The certain saturation value is not limited to those described above and may be optionally set.

As described above, the signal processing unit 20 detects the low-saturation pixels 48L. The low-saturation pixel number determining unit 75 then determines whether the number of low-saturation pixels 48L in the target image display region 41 is larger than the certain threshold.

Calculation of the Display Quality Maintenance Reference Value

The following describes calculation of the display quality maintenance reference value. The display quality maintenance reference value calculating unit 76 of the signal processing unit 20 calculates the display quality maintenance reference value. The display quality maintenance reference value calculating unit 76 acquires the information on the low-saturation pixels 48L in the target image display region 41 from the low-saturation pixel detecting unit 74. The display quality maintenance reference value calculating unit 76 also acquires the information on the tentative index values $1/\alpha_1$ of the pixels 48 in the target image display region 41 from the tentative $1/\alpha_1$ calculating unit 72. Based on the information on the low-saturation pixels 48L and the information on the tentative index values $1/\alpha_1$, the display quality maintenance reference value calculating unit 76 derives the tentative index values $1/\alpha_1$ of the low-saturation pixels 48L in the target image display region 41. Based on the tentative index values $1/\alpha_1$ of the low-saturation pixels 48L in the target image display region 41, the display quality maintenance reference value calculating unit 76 calculates the display quality maintenance reference value in the target image display region 41.

More specifically, the display quality maintenance reference value calculating unit 76 determines the largest tentative index value $1/\alpha_1$ out of the tentative index values $1/\alpha_1$ of the low-saturation pixels 48L in the target image display region 41 to be the display quality maintenance reference value in the target image display region 41. In other words, the display quality maintenance reference value calculating unit 76 determines the tentative index value $1/\alpha_1$ that maximizes the irradiation amount of light from the light source unit 60 out of the tentative index values $1/\alpha_1$ of the low-saturation pixels 48L in the target image display region 41 to be the display quality maintenance reference value.

Calculation of the Region Tentative Index Value

The following describes calculation of the region tentative index value $1/\alpha_4$. The region tentative $1/\alpha_4$ calculating unit 77 of the signal processing unit 20 uses a certain algorithm to calculate the region tentative index value $1/\alpha_4$ common to all the pixels 48 in the target image display region 41. The certain algorithm, for example, is the following processing: deriving distribution of the tentative index values $1/\alpha_1$ of the respective pixels 48 in the target image display region 41, and determining the largest tentative index value $1/\alpha_1$ out of the tentative index values $1/\alpha_1$ allocated to pixels of equal to or larger than a certain number to be the region tentative index value $1/\alpha_4$.

Calculation of the Comparative Light Irradiation Amount

Figure 16:
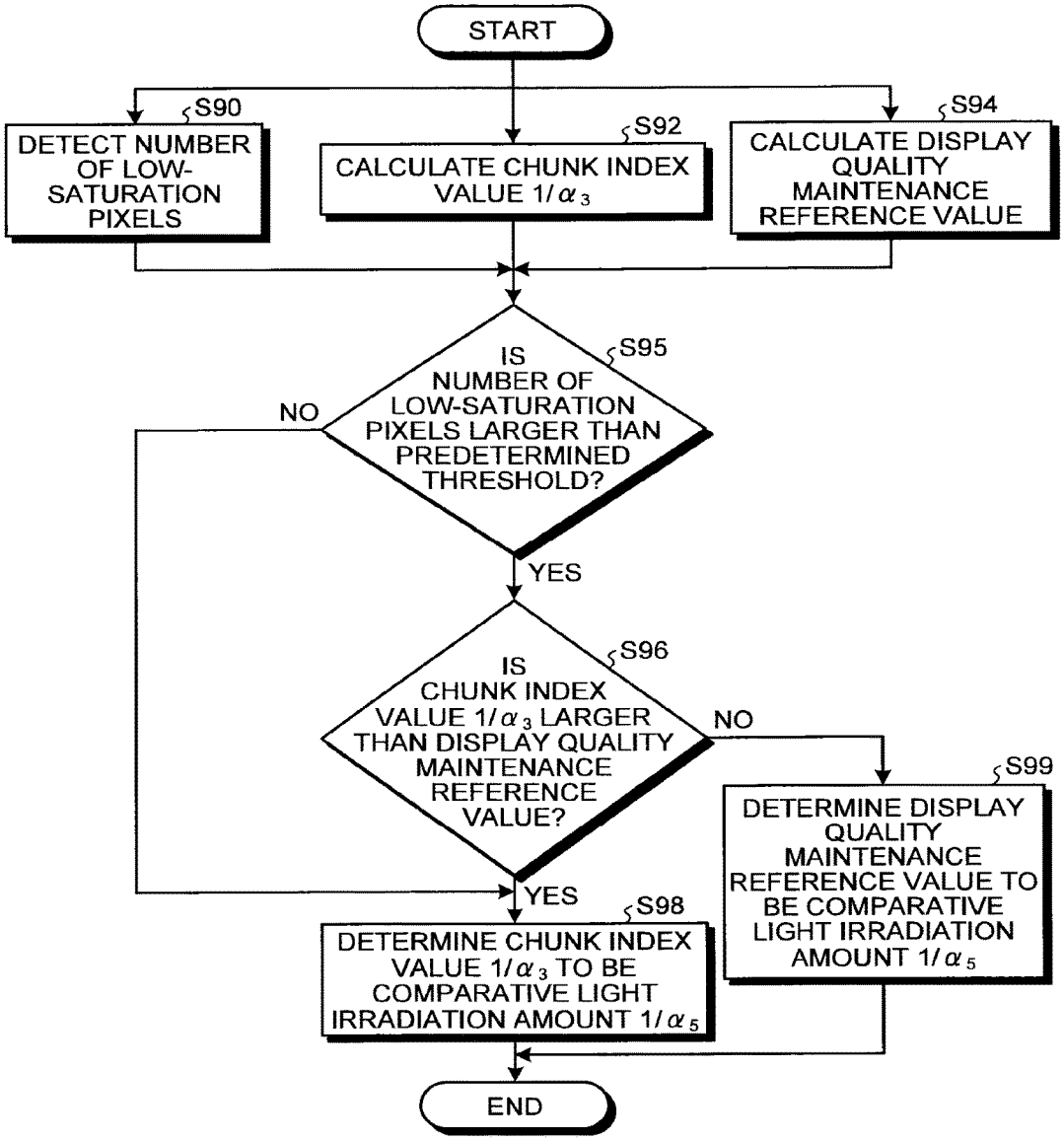
FIG. 16 is a flowchart for explaining calculation of a comparative light irradiation amount.

The following describes calculation of the comparative light irradiation amount $1/\alpha_5$. The comparative $1/\alpha_5$ unit 97 of the signal processing unit 20 calculates the comparative light irradiation amount $1/\alpha_5$. FIG. 16 is a flowchart for explaining calculation of the comparative light irradiation amount.

As illustrated in FIG. 16, the low-saturation pixel detecting unit 74 of the signal processing unit 20 calculates the number of low-saturation pixels 48L in the target image display region 41 (Step S90). The chunk $1/\alpha_3$ calculating unit 96 calculates the chunk index value $1/\alpha_3$ in the target image display region 41 (Step S92). The display quality maintenance reference value calculating unit 76 calculates the display quality maintenance reference value in the target image display region 41 (Step S94). The processing at Step S90 is performed by the low-saturation pixel detecting unit 74 as described above. The processing at Step S92 corresponds to the processing illustrated in FIG. 14. The processing at Step S94 is performed by the display quality maintenance reference value calculating unit 76 as described above. The processing at Step S90, Step S92, and Step S94 may be performed in parallel or in order. The processing at Step S94 may be performed after the processing at Step S95, which will be described later, as long as it is performed before the processing at Step S96, which will be described later.

After the number of low-saturation pixels 48L is calculated, the low-saturation pixel number determining unit 75 determines whether the number of low-saturation pixels 48L in the target image display region 41 is larger than the certain threshold (Step S95). If the number of low-saturation pixels 48L is larger than the certain threshold (Yes at Step S95), the comparative $1/\alpha_5$ unit 97 determines whether the chunk index value $1/\alpha_3$ is larger than the display quality maintenance reference value (Step S96).

If the chunk index value $1/\alpha_3$ is larger than the display quality maintenance reference value (Yes at Step S96), the comparative $1/\alpha_5$ unit 97 determines the chunk index value $1/\alpha_3$ to be the comparative light irradiation amount $1/\alpha_5$ in the target image display region 41 (Step S98).

By contrast, if the chunk index value $1/\alpha_3$ is not larger than the display quality maintenance reference value (No at Step S96), that is, if the chunk index value $1/\alpha_3$ is equal to or smaller than the display quality maintenance reference value, the comparative $1/\alpha_5$ unit 97 determines the display quality maintenance reference value to be the comparative light irradiation amount $1/\alpha_5$ in the target image display region 41 (Step S99). In other words, if the number of low-saturation pixels 48L is larger than the certain threshold, the comparative $1/\alpha_5$ unit 97 determines a larger one of the chunk index value $1/\alpha_3$ and the display quality maintenance reference value (one having a larger irradiation amount of light from the light source unit 60) to be the comparative light irradiation amount $1/\alpha_5$.

If the number of low-saturation pixels 48L is not larger than the certain threshold (No at Step S95), that is, if the number of low-saturation pixels 48L is equal to or smaller than the certain threshold, the comparative $1/\alpha_5$ unit 97 determines the chunk index value $1/\alpha_3$ to be the comparative light irradiation amount $1/\alpha_5$ in the target image display region 41 (Step S98). Thus, the calculation of the comparative light irradiation amount $1/\alpha_5$ is finished.

Calculation of the Light Irradiation Amount

Figure 17:
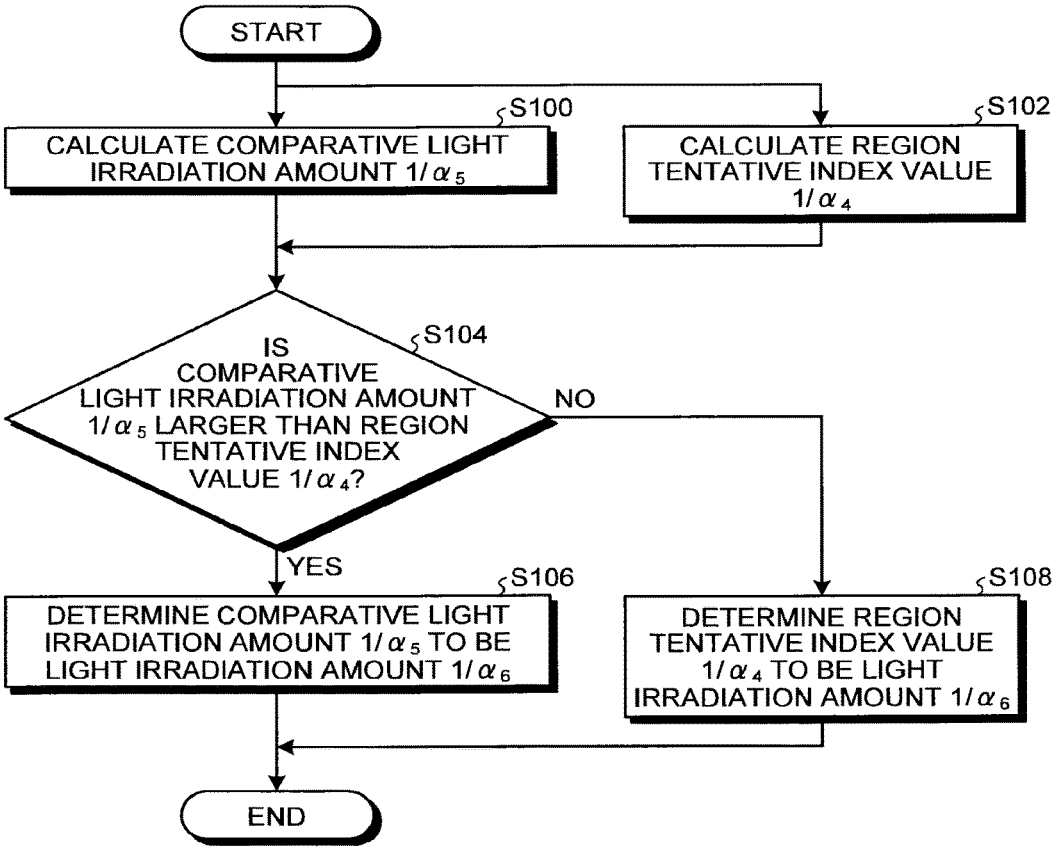
FIG. 17 is a flowchart for explaining calculation of a light irradiation amount.

The following describes calculation of the light irradiation amount $1/\alpha_6$. The $1/\alpha_6$ determining unit 98 of the signal processing unit 20 calculates the light irradiation amount $1/\alpha_6$. FIG. 17 is a flowchart for explaining calculation of the light irradiation amount.

As illustrated in FIG. 17, the comparative $1/\alpha_5$ unit 97 of the signal processing unit 20 calculates the comparative light irradiation amount $1/\alpha_5$ in the target image display region 41 (Step S100). The region tentative $1/\alpha_4$ calculating unit 77 calculates the region tentative index value $1/\alpha_4$ in the target image display region 41 (Step S102). The processing at Step S100 corresponds to the processing illustrated in FIG. 16. The processing at Step S102 is performed by the region tentative $1/\alpha_4$ calculating unit 77 as described above. The processing at Step S100 and the processing at Step S102 may be performed in parallel or in order as long as they are performed before the processing at Step S104, which will be described later.

After the comparative light irradiation amount $1/\alpha_5$ and the region tentative index value $1/\alpha_4$ are calculated, the $1/\alpha_6$ determining unit 98 determines whether the comparative light irradiation amount $1/\alpha_5$ is larger than the region tentative index value $1/\alpha_4$ (Step S104).

If the comparative light irradiation amount $1/\alpha_5$ is larger than the region tentative index value $1/\alpha_4$ (Yes at Step S104), the $1/\alpha_6$ determining unit 98 determines the comparative light irradiation amount $1/\alpha_5$ to be the light irradiation amount $1/\alpha_6$ (Step S106). By contrast, if the comparative light irradiation amount $1/\alpha_5$ is not larger than the region tentative index value $1/\alpha_4$ (No at Step S104), that is, if the comparative light irradiation amount $1/\alpha_5$ is equal to or smaller than the region tentative index value $1/\alpha_4$, the $1/\alpha_6$ determining unit 98 determines the region tentative index value $1/\alpha_4$ to be the light irradiation amount $1/\alpha_6$ (Step S108). In other words, the $1/\alpha_6$ determining unit 98 determines a larger one of the comparative light irradiation amount $1/\alpha_5$ and the region tentative index value $1/\alpha_4$ (one having a larger irradiation amount of light from the light source unit 60) to be the light irradiation amount $1/\alpha_6$. Thus, the calculation of the light irradiation amount $1/\alpha_6$ is finished.

The $1/\alpha_6$ determining unit 98 outputs the information on the calculated light irradiation amount $1/\alpha_6$ in the target image display region 41 to the light source driving unit 50. The light source driving unit 50 performs control such that the irradiation amount of light from the sidelight light source 62 that outputs light to the target image display region 41 corresponds to the light irradiation amount $1/\alpha_6$. Specifically, the irradiation amount of light from the sidelight light source 62 increases as the light irradiation amount $1/\alpha_6$ increases and decreases as the light irradiation amount $1/\alpha_6$ decreases.

Generation of Output Signals

The following describes generation of output signals. Based on the light irradiation amount $1/\alpha_6$, the $\alpha_6$ calculating unit 79 of the signal processing unit 20 calculates the expansion coefficient $\alpha_6$ common to the pixels 48 in the target image display region 41. The expansion coefficient $\alpha_6$ is the reciprocal of the light irradiation amount $1/\alpha_6$.

The output signal generating unit 80 of the signal processing unit 20 generates an output signal for the first sub-pixel (signal value $X_{1-(p,q)}$) for determining a display gradation of the first sub-pixel 49R, an output signal for the second sub-pixel (signal value $X_{2-(p,q)}$) for determining a display gradation of the second sub-pixel 49G, an output signal for the third sub-pixel (signal value $X_{3-(p,q)}$) for determining a display gradation of the third sub-pixel 49B, and an output signal for the fourth sub-pixel (signal value $X_{4-(p,q)}$) for determining a display gradation of the fourth sub-pixel 49W. The signal processing unit 20 then outputs these output signals to the image display panel driving unit 30. The following specifically describes generation of the output signals performed by the signal processing unit 20.

After calculating the expansion coefficient $\alpha_6$, the output signal generating unit 80 of the signal processing unit 20 calculates the output signal value $X_{4-(p,q)}$ for the fourth sub-pixel based on at least the input signal for the first sub-pixel (signal value $x_{1-(p,q)}$), the input signal for the second sub-pixel (signal value $x_{2-(p,q)}$), and the input signal for the third sub-pixel (signal value $x_{3-(p,q)}$). More specifically, the output signal generating unit 80 of the signal processing unit 20 calculates the output signal value $X_{4-(p,q)}$ for the fourth sub-pixel based on the product of $Min_{(p,q)}$ and the expansion coefficient $\alpha$. In actual operation, the signal processing unit 20 calculates the signal value $X_{4-(p,q)}$ based on Equation (6). While the product of $Min_{(p,q)}$ and the expansion coefficient $\alpha$ is divided by $\chi$ in Equation (6), the embodiment is not limited thereto.

$$X_{4-(p,q)}=Min_{(p,q)}\cdot\alpha_6/\chi \tag{6}$$

$\chi$ is a constant depending on the display device 10. No color filter is arranged for the fourth sub-pixel 49W that displays white. The fourth sub-pixel 49W that displays the fourth color is brighter than the first sub-pixel 49R that displays the first color, the second sub-pixel 49G that displays the second color, and the third sub-pixel 49B that displays the third color when irradiated with light of the same lighting amount from the light source. When a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Where $\chi$ is a constant depending on the display device 10, the constant $\chi$ is represented by $\chi=BN_4/BN_{1-3}$.

Specifically, the luminance $BN_4$ when the input signal having a value of display gradation 255 is assumed to be input to the fourth sub-pixel 49W is, for example, 1.5 times the luminance $BN_{1-3}$ of white where the input signals having values of display gradation such as the signal value $x_{1-(p,q)}=255$, the signal value $x_{2-(p,q)}=255$, and the signal value $x_{3-(p,q)}=255$, are input to the aggregate of the first sub-pixel 49R, the second sub-pixel 49G, and the third sub-pixel 49B. That is, in the first embodiment, $\chi=1.5$.

Subsequently, the output signal generating unit 80 of the signal processing unit 20 derives the output signal for the first sub-pixel (signal value $X_{1-(p,q)}$) based on at least the input signal for the first sub-pixel (signal value $x_{1-(p,q)}$) and the expansion coefficient $\alpha_6$. The output signal generating unit 80 also derives the output signal for the second sub-pixel (signal value $X_{2-(p,q)}$) based on at least the input signal for the second sub-pixel (signal value $x_{2-(p,q)}$) and the expansion coefficient $\alpha_6$. The output signal generating unit 80 also derives the output signal for the third sub-pixel (signal value $X_{3-(p,q)}$) based on at least the input signal for the third sub-pixel (signal value $x_{3-(p,q)}$) and the expansion coefficient $\alpha_6$.

Specifically, the signal processing unit 20 derives the output signal for the first sub-pixel based on the input signal for the first sub-pixel, the expansion coefficient $\alpha_6$, and the output signal for the fourth sub-pixel. The signal processing unit 20 also derives the output signal for the second sub-pixel based on the input signal for the second sub-pixel, the expansion coefficient $\alpha_6$, and the output signal for the fourth sub-pixel. The signal processing unit 20 also derives the output signal for the third sub-pixel based on the input signal for the third sub-pixel, the expansion coefficient $\alpha_6$, and the output signal for the fourth sub-pixel.

Specifically, the signal processing unit 20 calculates the output signal value $X_{1-(p,q)}$ for the first sub-pixel, the output signal value $X_{2-(p,q)}$ for the second sub-pixel, and the output signal value $X_{3-(p,q)}$ for the third sub-pixel supplied to the (p,q)-th pixel 48 (or a group of the first sub-pixel 49R, the second sub-pixel 49G, and the third sub-pixel 49B) using Equations (7) to (9), respectively, where $\chi$ is a constant depending on the display device 10.

$$X_{1-(p,q)}=\alpha_6\cdot x_{1-(p,q)}-\chi\cdot X_{4-(p,q)} \tag{7}$$

$$X_{2-(p,q)}=\alpha_6\cdot x_{2-(p,q)}-\chi\cdot X_{4-(p,q)} \tag{8}$$

$$X_{3-(p,q)}=\alpha_6\cdot x_{3-(p,q)}-\chi\cdot X_{4-(p,q)} \tag{9}$$

As described above, the signal processing unit 20 generates output signals of the sub-pixels 49. Next, the following describes a method of obtaining the signal values $X_{1-(p,q)}$, $X_{2-(p,q)}$, $X_{3-(p,q)}$, and $X_{4-(p,q)}$ that are output signals of the (p,q)-th pixel 48 (expansion processing). The following processing is performed to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed to also keep (maintain) color tone. In addition, the processing is performed to keep (maintain) a gradation-luminance characteristic (gamma characteristic, γ characteristic). When all of the input signal values are 0 or small values in any one of the pixels 48 or a group of the pixels 48, the expansion coefficient α may be obtained without including such a pixel 48 or a group of pixels 48.

First Step

First, the $\alpha_6$ calculating unit 79 of the signal processing unit 20 calculates the expansion coefficient $\alpha_6$ in the target image display region 41 from the light irradiation amount $1/\alpha_6$ in the target image display region 41.

Second Step

Subsequently, the signal processing unit 20 calculates the signal value $X_{4-(p,q)}$ in the (p,q)-th pixel 48 based on at least the signal value $x_{1-(p,q)}$, the signal value $x_{2-(p,q)}$, and the signal value $x_{3-(p,q)}$. The signal processing unit 20 according to the first embodiment determines the signal value $X_{4-(p,q)}$ based on $Min_{(p,q)}$, the expansion coefficient $\alpha_6$, and the constant $\chi$. More specifically, the signal processing unit 20 calculates the signal value $X_{4-(p,q)}$ based on Equation (6) as described above. The signal processing unit 20 calculates the signal value $X_{4-(p,q)}$ for all the pixels 48 in the target image display region 41.

Third Step

Subsequently, the signal processing unit 20 obtains the signal value $X_{1-(p,q)}$ in the (p,q)-th pixel 48 based on the signal value $x_{1-(p,q)}$, the expansion coefficient $\alpha_6$, and the signal value $X_{4-(p,q)}$, obtains the signal value $X_{2-(p,q)}$ in the (p,q)-th pixel 48 based on the signal value $x_{2-(p,q)}$, the expansion coefficient $\alpha_6$, and the signal value $X_{4-(p,q)}$, and obtains the signal value $X_{3-(p,q)}$ in the (p,q)-th pixel 48 based on the signal value $x_{3-(p,q)}$, the expansion coefficient $\alpha_6$, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ in the (p,q)-th pixel 48 based on Equations (7) to (9) described above.

The output signal generating unit 80 of the signal processing unit 20 generates the output signals by performing the process described above. The output signal generating unit 80 outputs the generated output signals to the image display panel driving unit 30.

Figure 18:
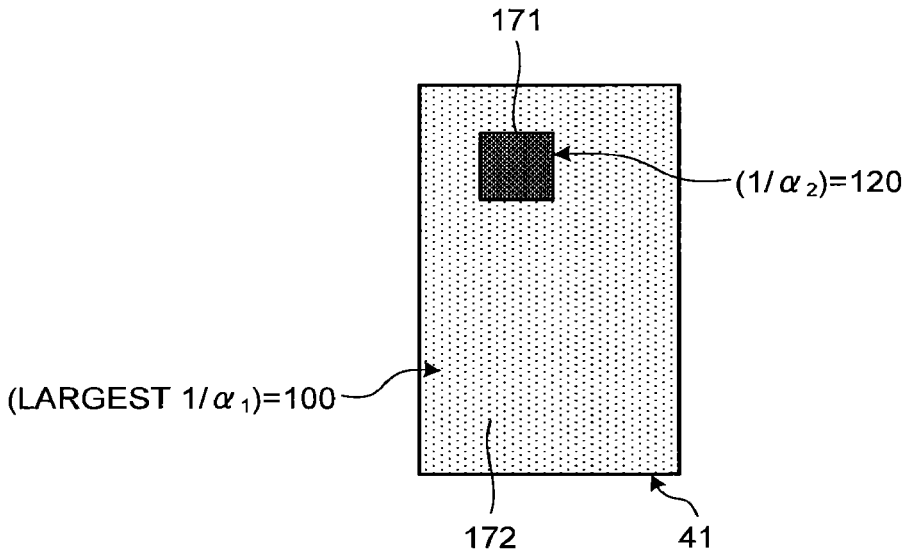
FIG. 18 is a diagram for explaining display performed when the processing according to the first embodiment is carried out.
Figure 19:
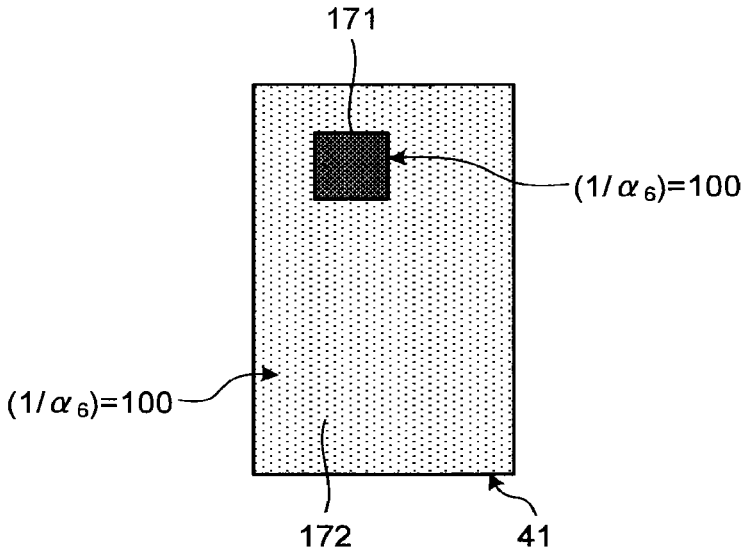
FIG. 19 is another diagram for explaining display performed when the processing according to the first embodiment is carried out.
Figure 20:
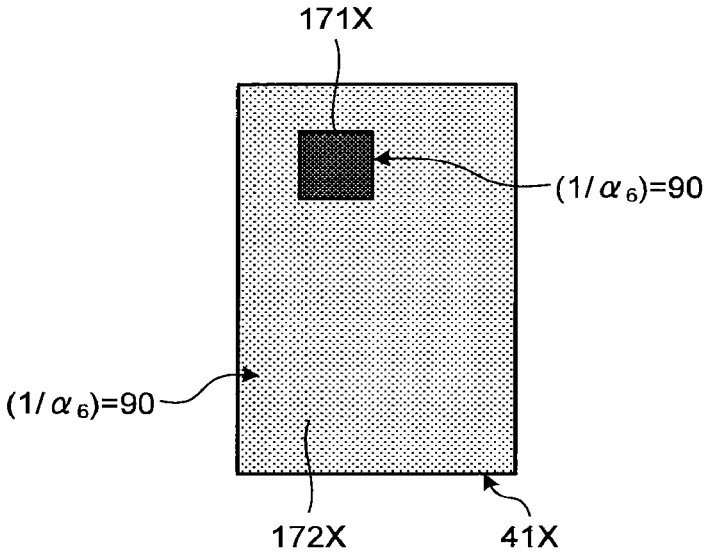
FIG. 20 is still another diagram for explaining display performed when the processing according to the first embodiment is carried out.

FIGS. 18 to 20 are diagrams for explaining display performed when the processing according to the first embodiment is carried out. In FIG. 18, a chunk 171 and a background 172 are displayed in an image display region 41. The chunk 171 includes no low-saturation pixel 48L, whereas the background 172 includes low-saturation pixels 48L. In the image display region 41, the number of low-saturation pixels 48L is larger than the certain threshold. As illustrated in FIG. 18, the chunk tentative index value $1/\alpha_2$ of the chunk 171 is 120. The largest value of the tentative index values $1/\alpha_1$ of the pixels 48 in the background 172 is 100, which is the largest value of the tentative index values $1/\alpha_1$ of the low-saturation pixels 48L. The region tentative index value $1/\alpha_4$ of the image display region 41 is 85.

Also in FIG. 19, the chunk 171 and the background 172 are displayed in the image display region 41. FIG. 19 illustrates the light irradiation amount $1/\alpha_6$ of the image display region 41 in a case where the processing according to the first embodiment is carried out. Let us assume a case where the hue correction value CV of the chunk 171 is 30. In this case, the chunk index value $1/\alpha_3$ of the chunk 171 is 90, which is obtained by subtracting the hue correction value CV from the chunk tentative index value $1/\alpha_2$. The display quality maintenance reference value is 100, which is the largest value of the tentative index values $1/\alpha_1$ of the low-saturation pixels 48L. The comparative light irradiation amount $1/\alpha_5$ of the image display region 41 is 100, which is the display quality maintenance reference value corresponding to a larger one of the chunk index value $1/\alpha_3$ and the display quality maintenance reference value. The light irradiation amount $1/\alpha_6$ of the image display region 41 is 100, which is the comparative light irradiation amount $1/\alpha_5$ corresponding to a larger one of the comparative light irradiation amount $1/\alpha_5$ and the region tentative index value $1/\alpha_4$. As illustrated in FIG. 19, both the chunk 171 and the background 172 have a light irradiation amount $1/\alpha_6$ of 100.

The display quality maintenance reference value, which is a reference value at which the display quality of the colors displayed by the low-saturation pixels 48L is maintained, is 100. In other words, the light irradiation amount $1/\alpha_6$ (irradiation amount of light from the light source unit 60)_required for the low-saturation pixels 48L to display the colors corresponding to the input signals is 100. As described above, performing the processing according to the first embodiment provides a light irradiation amount $1/\alpha_6$ of 100. Thus, by performing the processing according to the first embodiment, it is possible to secure the light irradiation amount required for the low-saturation pixels 48L and suppress reduction in the luminance of the colors displayed by the low-saturation pixels 48L. This makes it possible to prevent deterioration in the image.

In FIG. 20, a chunk 171X and a background 172X are displayed in an image display region 41X. FIG. 20 illustrates the light irradiation amount $1/\alpha_6$ of the image display region 41X in a case where processing according to a comparative example is carried out. The chunk 171X and the background 172X receive the same input signals as those received by the chunk 171 and the background 172, respectively. In the processing according to the comparative example, the signal processing unit 20 does not calculate the display quality maintenance reference value and uses the chunk index value $1/\alpha_3$ of the chunk 171X as the comparative light irradiation amount $1/\alpha_5$. In other words, the comparative light irradiation amount $1/\alpha_5$ in the comparative example corresponds to the chunk index value $1/\alpha_3$ of the chunk 171X and is 90. The region tentative index value $1/\alpha_4$ of the image display region 41X is 85. Thus, the light irradiation amount $1/\alpha_6$ of the image display region 41X according to the comparative example is 90. As illustrated in FIG. 20, both the chunk 171X and the background 172X have a light irradiation amount $1/\alpha_6$ of 90.

Also in the image display region 41X, the light irradiation amount $1/\alpha_6$ (irradiation amount of light from the light source unit 60) required for the low-saturation pixels 48L to display the colors corresponding to the input signals is 100. In the comparative example, however, the light irradiation amount $1/\alpha_6$ is 90. Thus, by performing the processing according to the comparative example, the light irradiation amount required for the low-saturation pixels 48L may possibly fail to be secured, resulting in reduction in the luminance of the colors displayed by the low-saturation pixels 48L. By contrast, by performing the processing according to the first embodiment, it is possible to suppress reduction in the luminance of the colors displayed by the low-saturation pixels 48L. Because the low-saturation pixels 48L especially have lower saturation, reduction in the luminance thereof is more likely to be recognized by an observer. The display device 10 according to the first embodiment can suppress reduction in the luminance of the low-saturation pixels 48L, thereby suitably preventing deterioration in the image.

As described above, the low-saturation pixel detecting unit 74 of the display device 10 according to the first embodiment detects low-saturation pixels 48L in the target image display region 41. The light irradiation amount calculating unit 78 of the display device 10 calculates the comparative light irradiation amount $1/\alpha_5$ of the target image display region 41 based on: the result of detection performed by the low-saturation pixel detecting unit 74; the display quality maintenance reference value at which the display quality of the colors displayed by the low-saturation pixels 48L is maintained; and the index value based on the tentative index values $1/\alpha_1$ of the pixels 48 included in the target image display region 41. Based on the comparative light irradiation amount $1/\alpha_5$, the light irradiation amount calculating unit 78 calculates the light irradiation amount $1/\alpha_6$. The display device 10 calculates the light irradiation amount $1/\alpha_6$ based on the result of detection performed by the low-saturation pixel detecting unit 74, the display quality maintenance reference value, and the index value. The light source unit 60 outputs light of the irradiation amount corresponding to the light irradiation amount $1/\alpha_6$ to the target image display region 41. Thus, the display device 10 can suppress reduction in the luminance of the low-saturation pixels 48L, thereby suitably preventing deterioration in the image.

The chunk tentative $1/\alpha_2$ calculating unit 92 of the display device 10 determines whether the tentative index value $1/\alpha_1$ is continuous in a plurality of pixels 48. If it is determined that the tentative index value $1/\alpha_1$ is continuous, the chunk tentative $1/\alpha_2$ calculating unit 92 determines the region of the continuous pixels 48 to be a chunk. The chunk tentative $1/\alpha_2$ calculating unit 92 determines the tentative index value $1/\alpha_1$ of the continuous pixels to be the chunk tentative index value $1/\alpha_2$. The index value is calculated based on the chunk tentative index value $1/\alpha_2$. In a case where the chunk tentative index value $1/\alpha_2$ is large, for example, the display device 10 can prevent the light irradiation amount from being insufficient for the chunk, thereby preventing deterioration in the image quality.

If the number of low-saturation pixels 48L is larger than the certain threshold, the light irradiation amount calculating unit 78 of the display device 10 determines a value having a larger light irradiation amount between the index value and the display quality maintenance reference value to be the comparative light irradiation amount $1/\alpha_5$. If the number of low-saturation pixels 48L is equal to or smaller than the certain threshold, the light irradiation amount calculating unit 78 determines the index value to be the comparative light irradiation amount $1/\alpha_5$. If the number of low-saturation pixels 48L is large, the display device 10 determines the light irradiation amount $1/\alpha_6$ based on a value having a larger light irradiation amount between the index value and the display quality maintenance reference value. Thus, if the number of low-saturation pixels 48L is large, and deterioration in the image is more likely to be recognized, the display device 10 suppresses reduction in the light irradiation amount, thereby preventing deterioration in the image. By contrast, if the number of low-saturation pixels 48L is small, and deterioration in the image is less likely to be recognized, the display device 10 appropriately controls the light irradiation amount based on the index value, thereby reducing power consumption.

The display device 10 calculates the chunk index value $1/\alpha_3$ based on the chunk tentative index value $1/\alpha_2$ and the correction value. The display device 10 calculates the index value based on the chunk index value $1/\alpha_3$. The display device 10 can appropriately reduce the chunk index value $1/\alpha_3$ using the correction value based on the hue. Thus, the display device 10 can more appropriately reduce power consumption and prevent deterioration in the image quality. The display device 10 does not necessarily calculate the correction value or the chunk index value $1/\alpha_3$ and may use the chunk tentative index value $1/\alpha_2$ as the index value.

The display device 10 calculates the region tentative index value $1/\alpha_4$ and determines a larger one of the comparative light irradiation amount $1/\alpha_5$ and the region tentative index value $1/\alpha_4$ to be the light irradiation amount $1/\alpha_6$. Thus, the display device 10 can prevent the light irradiation amount from being too small, thereby more suitably preventing deterioration in the image quality.

The display device 10 determines the tentative index value $1/\alpha_1$ that maximizes the light irradiation amount out of the tentative index values $1/\alpha_1$ of the low-saturation pixels 48L to be the display quality maintenance reference value. Thus, the display device 10 can prevent the light irradiation amount $1/\alpha_6$ from being smaller than the light irradiation amount required for the low-saturation pixels 48L, thereby more suitably preventing deterioration in the image quality.

The display quality maintenance reference value simply needs to be a reference value at which the display quality of the colors displayed by the low-saturation pixels 48L is maintained and is not necessarily calculated based on the tentative index values $1/\alpha_1$ of the low-saturation pixels 48L. In this case, the display quality maintenance reference value simply needs to be large enough to prevent recognition of darkening of the colors displayed by the low-saturation pixels 48L. The display quality maintenance reference value may be a predetermined constant, such as $1/(1+\chi)$. In this case, the light irradiation amount $1/\alpha_6$ is equal to or larger than the display quality maintenance reference value of $1/(1+\chi)$. Even if the saturation of the low-saturation pixels 48L is 0, the light irradiation amount $1/\alpha_6$ is prevented from being smaller than the light irradiation amount required for the low-saturation pixels 48L. Also in this case, the display device 10 can prevent the light irradiation amount from being too small, thereby more suitably preventing deterioration in the image quality. Even if the saturation of the pixels 48 is 0 (achromatic color), setting the display quality maintenance reference value to $1/(1+\chi)$ can prevent the light irradiation amount $1/\alpha_6$ from being smaller than the light irradiation amount required for the low-saturation pixels 48L.

The display device 10 includes the fourth sub-pixel 49W and performs expansion using the expansion coefficient $\alpha_6$. Thus, the display device 10 can prevent deterioration in the image and reduce the irradiation amount of light from the light source unit 60, resulting in reduced power consumption.

Second Embodiment

The following describes a second embodiment of the present invention. A display device 10 according to the second embodiment is different from the display device 10 according to the first embodiment in the method for calculating the display quality maintenance reference value. Explanation will be omitted for components of the display device 10 according to the second embodiment common to those of the display device 10 according to the first embodiment.

A display quality maintenance reference value calculating unit 76 according to the second embodiment classifies the tentative index values $1/\alpha_1$ of the low-saturation pixels 48L according to the frequency distribution to classify the low saturation pixels 48L according to the grade. The display quality maintenance reference value calculating unit 76 classifies the low-saturation pixels 48L according to the grades, thereby calculating the display quality maintenance reference value. Table 1 indicates an example of classification of the low-saturation pixels 48L.

TABLE 1

| | Value range of $1/\alpha_1$ | Number of low-saturation pixels (pixels) |
|---|---|---|
| Value group 1 | 0-0.1 | 50 |
| Value group 2 | 0.1-0.2 | 10 |
| Value group 3 | 0.2-0.3 | 40 |
| . | . | . |
| . | . | . |
| . | . | . |
| Value group n − 1 | 0.8-0.9 | 30 |
| Value group n | 0.9-1 | 15 |

As indicated by Table 1, the display quality maintenance reference value calculating unit 76 classifies a value range of the tentative index value $1/\alpha_1$ into a plurality of pixel groups (grades). More specifically, the pixel groups are composed of n grades of a value group 1, a value group 2, a value group 3, . . . , a value group n−1, and a value group n. In the example indicated by Table 1, the tentative index values $1/\alpha_1$ of the low-saturation pixels 48L can vary from 0 to 1. The value group 1 indicates a value range of equal to or larger than 0 and smaller than 0.1. The value group 2 indicates a value range of equal to or larger than 0.1 and smaller than 0.2. The value group 3 indicates a value range of equal to or larger than 0.2 and smaller than 0.3. The value group n−1 indicates a value range of equal to or larger than 0.8 and smaller than 0.9. The value group n indicates a value range of 0.9 to 1. In the example indicated by Table 1, all the value groups (the value group 1, the value group 2, the value group 3, . . . , the value group n−1, and the value group n) correspond to the allowable value range of 0 to 1 of the tentative index values $1/\alpha_1$ of the low-saturation pixels 48L.

The display quality maintenance reference value calculating unit 76 classifies the tentative index values $1/\alpha_1$ of the low-saturation pixels 48L in the target image display region 41 in each pixel group (grade) according to the frequency distribution. In other words, the display quality maintenance reference value calculating unit 76 detects a value group the value range of which includes the tentative index values $1/\alpha_1$ of the low-saturation pixels 48L. Thus, the display quality maintenance reference value calculating unit 76 classifies the low-saturation pixels 48L in each value group. The display quality maintenance reference value calculating unit 76 classifies all the low-saturation pixels 48L in the target image display region 41. In the example indicated by Table 1, the number of low-saturation pixels 48L classified as the value group 1, that is, the number of low-saturation pixels 48L the tentative index value $1/\alpha_1$ of which is 0 to 0.1 is 50. The number of low-saturation pixels 48L classified as the value group 2 is 10. The number of low-saturation pixels 48L classified as the value group 3 is 40. The number of low-saturation pixels 48L classified as the value group n−1 is 30. The number of low-saturation pixels 48L classified as the value group n is 15. The number of low-saturation pixels 48L associated with the value groups between the value group 3 and the value group n−1 is smaller than 20.

The display quality maintenance reference value calculating unit 76 determines whether the number of classified low-saturation pixels 48L is equal to or larger than a certain number of pixels for each value group. The display quality maintenance reference value calculating unit 76 detects a value group having a certain number or more of low-saturation pixels 48L. In the example indicated by Table 1, the certain number of pixels is 20. Thus, in the example indicated by Table 1, the value groups having a certain number or more of low-saturation pixels 48L are the value group 1, the value group 3, and the value group n−1.

The display quality maintenance reference value calculating unit 76 selects the largest value group having the largest value in the value range out of the value groups having a certain number or more of low-saturation pixels 48L. Because the value group n−1 has the largest value in the example indicated by Table 1, the display quality maintenance reference value calculating unit 76 selects the value group n−1 as the largest value group. The display quality maintenance reference value calculating unit 76 determines the value included in the value range of the largest value group to be the display quality maintenance reference value. More specifically, the display quality maintenance reference value calculating unit 76 determines the largest value included in the value range of the largest value group to be the display quality maintenance reference value. In the example indicated by Table 1, the display quality maintenance reference value calculating unit 76 determines 0.9, which is the largest value included in the value group n−1, to be the display quality maintenance reference value. The display quality maintenance reference value is not necessarily the largest value as long as it is included in the value range of the largest value group. Table 1 indicates an example of classification of the low-saturation pixels 48L, and the number of the value groups and the value range thereof may be optionally set.

As described above, the display quality maintenance reference value calculating unit 76 classifies the value range of the tentative index value $1/\alpha_1$ into a plurality of grades. The display quality maintenance reference value calculating unit 76 classifies the tentative index values $1/\alpha_1$ of the low-saturation pixels 48L into the grades according to the frequency distribution, thereby classifying the low-saturation pixels 48L according to the grades. The display quality maintenance reference value calculating unit 76 detects grades (value groups) having a certain number or more of low-saturation pixels 48L. The display quality maintenance reference value calculating unit 76 selects the largest grade (largest value group) having the largest value in the value range out of the detected grades (value groups). The display quality maintenance reference value calculating unit 76 determines a value included in the value range of the selected largest grade (largest value group) to be the display quality maintenance reference value. Let us assume a case where first low-saturation pixels 48L having large tentative index values $1/\alpha_1$ are present, but the number thereof is small. In this case, the display device 10*a* according to the second embodiment determines the irradiation amount of light from the light source unit 60 based on second saturation pixels 48L having tentative index values $1/\alpha_1$ smaller than those of the first low-saturation pixels 48L. Thus, if there are low-saturation pixels 48L having large tentative index values $1/\alpha_1$ but the number of which is small, the display device 10*a* according to the second embodiment can suitably reduce the irradiation amount of light from the light source unit 60, thereby reducing power consumption. Because the number of first low-saturation pixels 48L having large tentative index values $1/\alpha_1$ is small, reduction in the luminance is less likely to be recognized, resulting in prevention of deterioration in the image.

While the display quality maintenance reference value is preferably calculated based on the tentative index values $1/\alpha_1$ of the low-saturation pixels 48L as described in the first and the second embodiments, a desired calculation method may be employed. The display quality maintenance reference value is a reference value at which the display quality of the colors displayed by the low-saturation pixels 48L is maintained. The display quality maintenance reference value simply needs to be large enough to prevent deterioration in the colors displayed by the low-saturation pixels 48L.

Third Embodiment

The following describes a third embodiment of the present invention. A display device 10 according to the third embodiment is different from the display device 10 according to the first embodiment in that the display device 10*b* detects a chunk of the low-saturation pixels 48L. Explanation will be omitted for components of the display device 10 according to the third embodiment common to those of the display device 10 according to the first embodiment.

Figure 21:
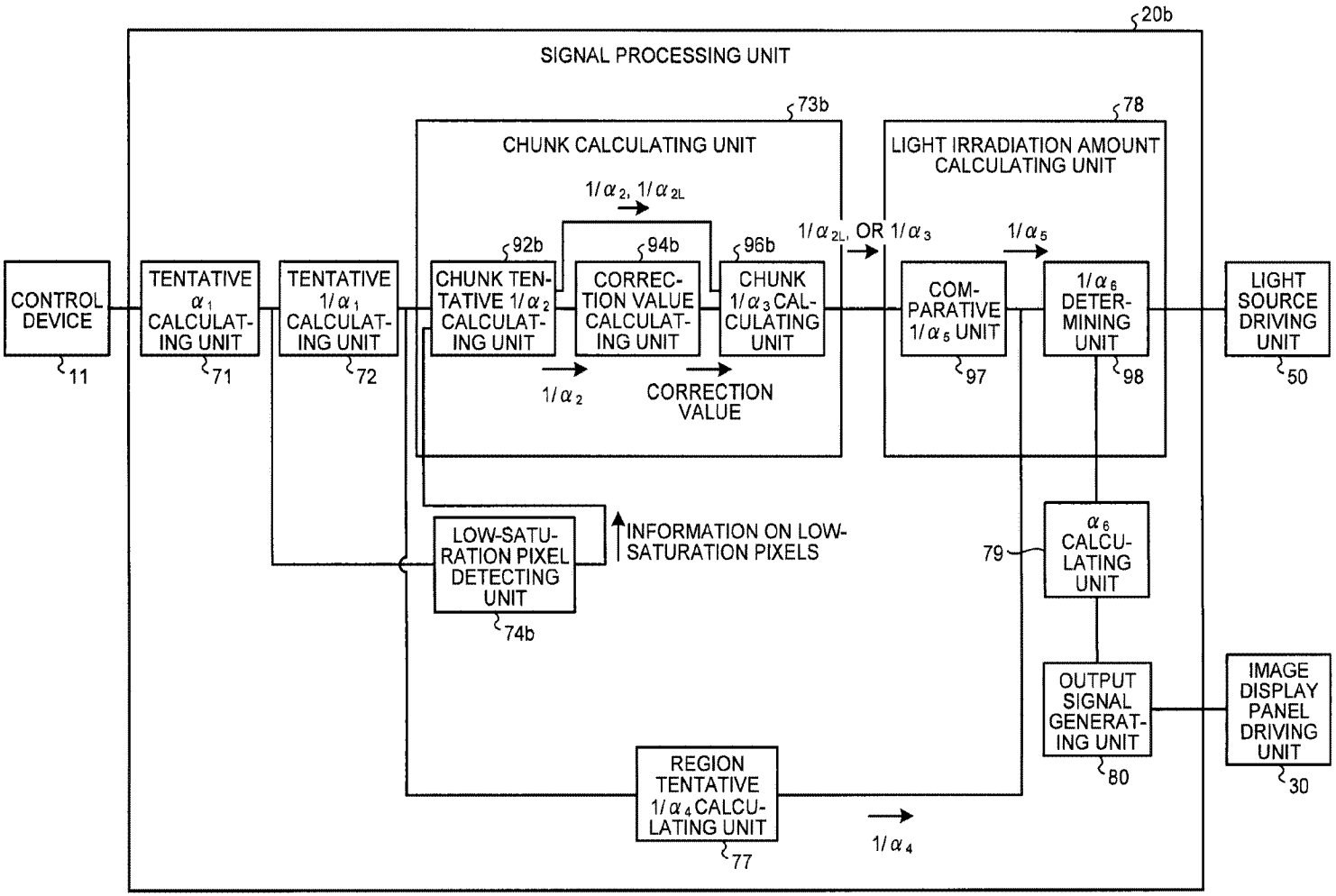
FIG. 21 is a block diagram of a configuration of a signal processing unit according to a third embodiment of the present invention.

FIG. 21 is a block diagram of a configuration of a signal processing unit according to the third embodiment. As illustrated in FIG. 21, a signal processing unit 20*b* according to the third embodiment includes a chunk calculating unit 73*b* and a low-saturation pixel detecting unit 74*b*. The chunk calculating unit 73*b* includes a chunk tentative $1/\alpha_2$ calculating unit 92*b*, a correction value calculating unit 94*b*, and a chunk $1/\alpha_3$ calculating unit 96*b*. The signal processing unit 20*b* does not include the low-saturation pixel number determining unit 75 or the display quality maintenance reference value calculating unit 76.

The chunk tentative $1/\alpha_2$ calculating unit 92*b* detects a chunk in the target image display region 41 with the same method as that performed by the chunk tentative $1/\alpha_2$ calculating unit 92 according to the first embodiment, thereby calculating the chunk tentative index value $1/\alpha_2$. The chunk tentative $1/\alpha_2$ calculating unit 92*b* acquires a result of detection of the low-saturation pixels 48L, that is, information on which of the pixels 48 are the low-saturation pixels 48L from the low-saturation pixel detecting unit 74*b*. In a case where a plurality of chunks is detected, the chunk tentative index value $1/\alpha_2$ is the largest value of the chunk tentative index values $1/\alpha_2$ of the detected chunks. As described above, the third embodiment calculates the largest chunk tentative index value $1/\alpha_2$. If the detected chunk is a pixel group of the low-saturation pixels 48L, the third embodiment also calculates the chunk tentative index value $1/\alpha_2$ of the chunk of the low-saturation pixels 48 regardless of whether it is the largest chunk tentative index value $1/\alpha_2$. In the following description, the chunk tentative index value of the low-saturation pixels 48L is referred to as a chunk tentative index value $1/\alpha_{2L}$ of low-saturation pixels. Thus, the chunk tentative $1/\alpha_2$ calculating unit 92*b* calculates the chunk tentative index value $1/\alpha_2$ and the chunk tentative index value $1/\alpha_{2L}$ of low-saturation pixels.

Figure 22:
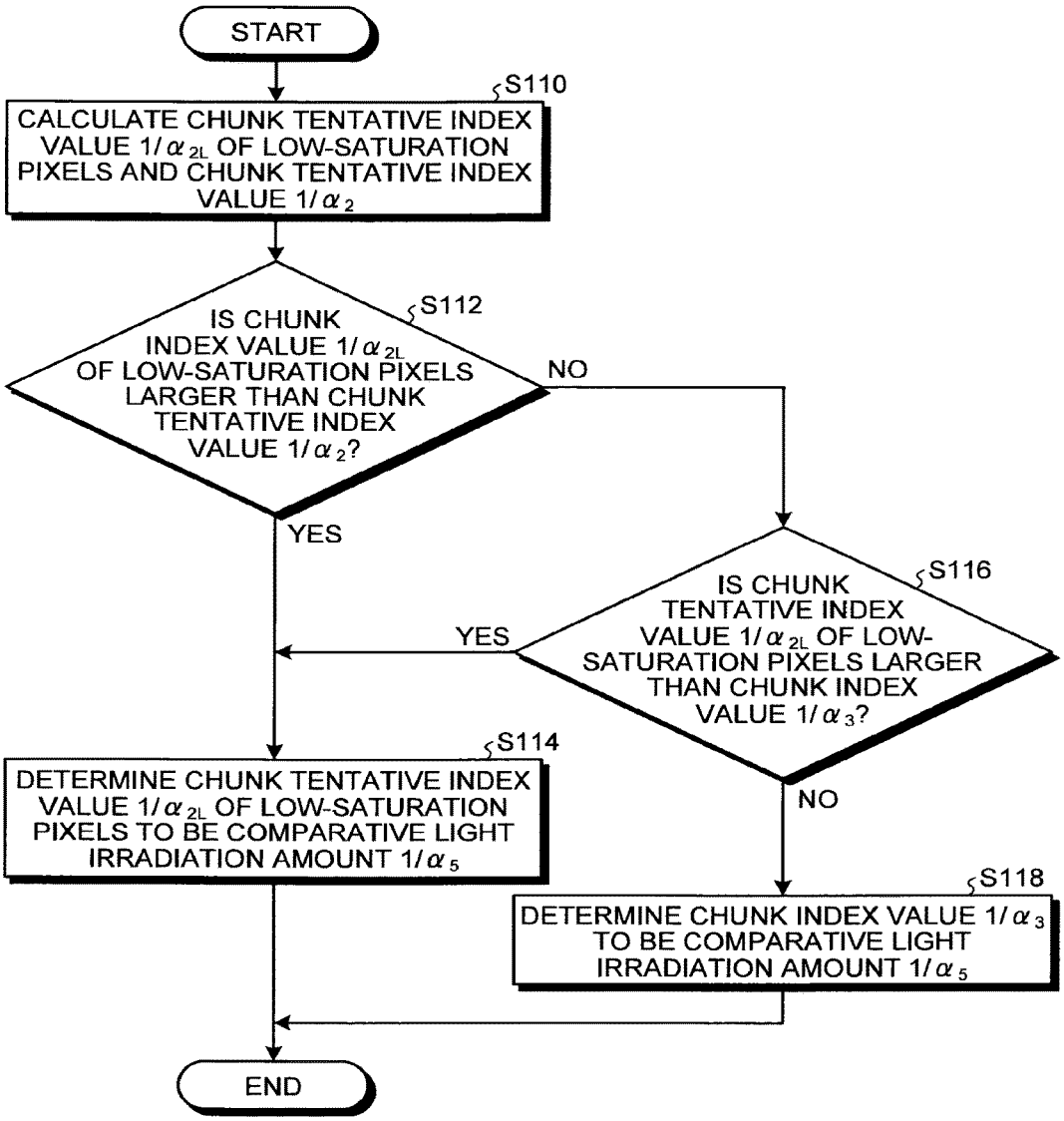
FIG. 22 is a flowchart for explaining calculation of the comparative light irradiation amount performed by the signal processing unit according to the third embodiment.

The following describes calculation of the comparative light irradiation amount $1/\alpha_5$ performed by the signal processing unit 20*b* with reference to a flowchart. FIG. 22 is a flowchart for explaining calculation of the comparative light irradiation amount performed by the signal processing unit according to the third embodiment.

As illustrated in FIG. 22, the chunk tentative $1/\alpha_2$ calculating unit 92*b* calculates the chunk tentative index value $1/\alpha_2$ and the chunk tentative index value $1/\alpha_{2L}$ of low-saturation pixels in the target image display region 41 (Step S110).

After the chunk tentative index value $1/\alpha_2$ and the chunk tentative index value $1/\alpha_{2L}$ of low-saturation pixels are calculated, the chunk $1/\alpha_3$ calculating unit 96*b* determines whether the chunk tentative index value $1/\alpha_{2L}$ of low-saturation pixels is larger than the chunk tentative index value $1/\alpha_2$ (Step S112).

If the chunk tentative index value $1/\alpha_{2L}$ of low-saturation pixels is larger than the chunk tentative index value $1/\alpha_2$ (Yes at Step S112), the comparative $1/\alpha_5$ unit 97 determines the chunk tentative index value $1/\alpha_{2L}$ of low-saturation pixels to be the comparative light irradiation amount $1/\alpha_5$ (Step S114). In this case, the comparative $1/\alpha_5$ unit 97 acquires the information on the chunk tentative index value $1/\alpha_{2L}$ of low-saturation pixels and determines the chunk tentative index value $1/\alpha_{2L}$ of low-saturation pixels to be the comparative light irradiation amount $1/\alpha_5$.

By contrast, if the chunk tentative index value $1/\alpha_{2L}$ of low-saturation pixels is not larger than the chunk tentative index value $1/\alpha_2$ (No at Step S112), that is, if the chunk tentative index value $1/\alpha_{2L}$ of low-saturation pixels is equal to or smaller than the chunk tentative index value $1/\alpha_2$, the chunk $1/\alpha_3$ calculating unit 96*b* determines whether the chunk tentative index value $1/\alpha_{2L}$ of low-saturation pixels is larger than the chunk index value $1/\alpha_3$ (Step S116). In other words, after comparing the chunk tentative index value $1/\alpha_{2L}$ of low-saturation pixels with the chunk tentative index value $1/\alpha_2$, the chunk $1/\alpha_3$ calculating unit 96*b* compares the chunk tentative index value $1/\alpha_{2L}$ of low-saturation pixels with the chunk index value $1/\alpha_3$ obtained by correcting the chunk tentative index value $1/\alpha_2$ with the correction value.

If the chunk tentative index value $1/\alpha_{2L}$ of low-saturation pixels is larger than the chunk index value $1/\alpha_3$ (Yes at Step S116), the comparative $1/\alpha_5$ unit 97 performs the processing at Step S114 to determine the chunk tentative index value $1/\alpha_{2L}$ of low-saturation pixels to be the comparative light irradiation amount $1/\alpha_5$.

By contrast, if the chunk tentative index value $1/\alpha_{2L}$ of low-saturation pixels is not larger than the chunk index value $1/\alpha_3$ (No at Step S116), that is, if the chunk tentative index value $1/\alpha_{2L}$ of low-saturation pixels is equal to or smaller than the chunk index value $1/\alpha_3$, the comparative $1/\alpha_5$ unit 97 determines the chunk index value $1/\alpha_3$ to be the comparative light irradiation amount $1/\alpha_5$ (Step S118). In this case, the comparative $1/\alpha_5$ unit 97 acquires the information on the chunk index value $1/\alpha_3$ and determines the chunk index value $1/\alpha_3$ to be the comparative light irradiation amount $1/\alpha_5$. Thus, the calculation of the comparative light irradiation amount $1/\alpha_5$ is finished. The processing is summarized as follows: the signal processing unit 20*b* determines a larger one of the chunk tentative index value $1/\alpha_{2L}$ of low-saturation pixels and the chunk index value $1/\alpha_3$ (one having a larger irradiation amount of light from the light source unit 60) to be the comparative light irradiation amount $1/\alpha_5$. Subsequently, the signal processing unit 20*b* calculates the light irradiation amount $1/\alpha_6$ with the same method as that in the first embodiment to generate output signals.

Figure 23:
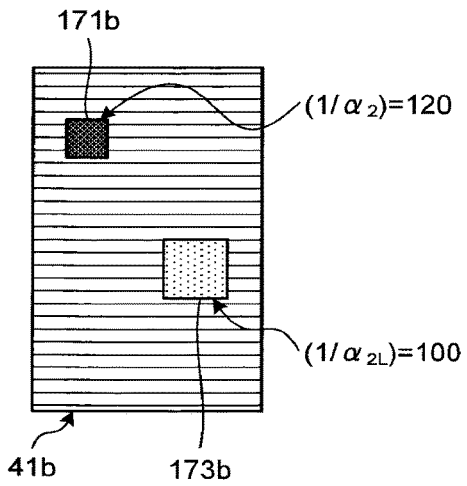
FIG. 23 is a diagram for explaining display performed when the processing according to the third embodiment is carried out.

FIG. 23 is a diagram for explaining display performed when the processing according to the third embodiment is carried out. In FIG. 23, a chunk 171*b* and a chunk 173*b* are displayed in an image display region 41*b*. The chunk 171*b* includes no low-saturation pixel 48L, whereas the chunk 173*b* is composed of the low-saturation pixels 48L. As illustrated in FIG. 23, the chunk tentative index value $1/\alpha_2$ of the chunk 171*b* is 120, whereas the chunk tentative index value $1/\alpha_{2L}$ of low-saturation pixels of the chunk 173*b* is 100.

Let us assume a case where the correction value of the chunk 171*b* is 30. In this case, the chunk index value $1/\alpha_3$ of the chunk 171*b* is 90, which is obtained by subtracting the correction value from the chunk tentative index value $1/\alpha_2$. The comparative light irradiation amount $1/\alpha_5$ of the image display region 41*b* is 100, which is the chunk tentative index value $1/\alpha_2$ of low-saturation pixels corresponding to a larger one of the chunk index value $1/\alpha_3$ and the chunk tentative index value $1/\alpha_2$ of low-saturation pixels. Thus, by performing the processing according to the third embodiment, it is possible to secure the light irradiation amount required for the low-saturation pixels 48L and suppress reduction in the luminance of the colors displayed by the low-saturation pixels 48L. This makes it possible to prevent deterioration in the image.

As described above, the display device 10 according to the third embodiment calculates the chunk tentative index value $1/\alpha_{2L}$ of low-saturation pixels. The display device 10 determines a larger one of the chunk tentative index value $1/\alpha_{2L}$ of low-saturation pixels and the chunk index value $1/\alpha_3$ (one having a larger irradiation amount of light from the light source unit 60) to be the comparative light irradiation amount $1/\alpha_5$. In other words, the display device 10 uses the chunk tentative index value $1/\alpha_{2L}$ of low-saturation pixels as the display quality maintenance reference value according to the first embodiment. The chunk calculating unit 73*b* according to the third embodiment detects a chunk composed of the low-saturation pixels 48L. The light irradiation amount calculating unit 78 uses the chunk tentative index value $1/\alpha_{2L}$ of low-saturation pixels as the display quality maintenance reference value to determine one having a larger irradiation amount of light between the index value and the display quality maintenance reference value to be the comparative light irradiation amount $1/\alpha_5$. Thus, the display device 10 according to the third embodiment suppresses reduction in the luminance of the colors displayed by the low-saturation pixels 48L, thereby preventing deterioration in the image.

Modification

The following describes a modification of the first embodiment. A display device 10 according to the modification is different from the display device 10 according to the first embodiment in the method for calculating the correction value. A correction value calculating unit 94 according to the modification calculates a correction value $CV_d$ used to correct the chunk tentative index value $1/\alpha_2$ based on the hue correction value CV indicated by the curve CV1 in FIG. 14B and a correction value adjustment term $CV_x$. In other words, while the first embodiment uses the hue correction value CV to correct the chunk tentative index value $1/\alpha_2$, the modification uses the correction value $CV_d$ to correct the chunk tentative index value $1/\alpha_2$.

Figure 24:
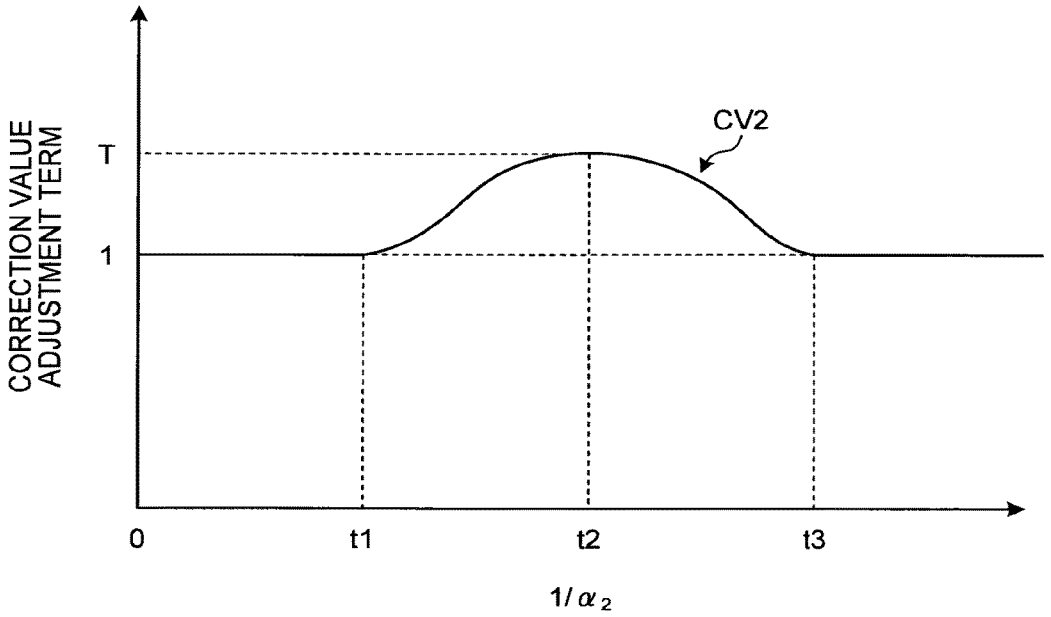
FIG. 24 is a graph for explaining an example of calculation of a correction value adjustment term.

The correction value adjustment term $CV_x$ is used to adjust the hue correction value CV based on the chunk tentative index value $1/\alpha_2$. The correction value adjustment term $CV_x$ varies depending on the chunk tentative index value $1/\alpha_2$. FIG. 24 is a graph for explaining an example of calculation of the correction value adjustment term. The abscissa in FIG. 24 indicates the chunk tentative index value $1/\alpha_2$, and the ordinate indicates the correction value adjustment term $CV_x$. The curve CV2 in FIG. 24 indicates the correction value adjustment term $CV_x$ varying depending on the chunk tentative index value $1/\alpha_2$. As indicated by the curve CV2, the correction value adjustment term $CV_x$ is 1 when the chunk tentative index value $1/\alpha_2$ is 0 to a certain value t1. As the chunk tentative index value $1/\alpha_2$ increases from the certain value t1 to a certain value t2, the correction value adjustment term $CV_x$ increases from 1 to a certain value T. As the chunk tentative index value $1/\alpha_2$ increases from the certain value t2 to a certain value t3, the correction value adjustment term $CV_x$ decreases from the certain value T to 1. The correction value adjustment term $CV_x$ is 1 when the chunk tentative index value $1/\alpha_2$ is equal to or larger than the certain value t3. The certain values t1, t2, and t3 may be desired values as long as the certain value t1 is larger than 0, the certain value t2 is larger than the certain value t1, and the certain value t3 is larger than the certain value t2. The certain value T may also be a desired value as long as it is larger than 1. The correction value adjustment term $CV_x$ may also be a desired value as long as it is larger than 1 when the chunk tentative index value $1/\alpha_2$ is larger than the certain value t1 and smaller than the certain value t3.

The correction value calculating unit 94 according to the modification calculates the correction value $CV_d$ based on the correction value CV indicated by the curve CV1 in FIG. 14B and the correction value adjustment term $CV_x$ indicated by the curve CV2 in FIG. 24. Specifically, the correction value calculating unit 94 calculates the correction value $CV_d$ based on Equation (10) where $CV_A$ denotes the correction value adjustment term for a certain chunk, and $CV_{XA}$ denotes the correction value adjustment term $CV_x$ for the certain chunk.

$$CV_d = CV_A \cdot CV_{XA} \tag{10}$$

As indicated by Equation (10), the correction value $CV_d$ is obtained by multiplying the hue correction value CV by the correction value adjustment term $CV_x$. The display device 10 according to the modification uses the correction value $CV_d$ instead of the hue correction value CV in Equation (5), thereby calculating the chunk index value $1/\alpha_3$.

The correction value adjustment term $CV_x$ is larger than 1 when the chunk tentative index value $1/\alpha_2$ is an intermediate value between t1 and t3. Thus, the correction value $CV_d$ is larger than the hue correction value CV when the chunk tentative index value $1/\alpha_2$ is an intermediate value. In other words, the correction value adjustment term $CV_x$ makes the correction value larger when the chunk tentative index value $1/\alpha_2$ is an intermediate value. The correction value calculating unit 94*d* according to the modification can make the correction value larger when the chunk tentative index value $1/\alpha_2$ is an intermediate value. Thus, the display device 10 according to the modification can more appropriately reduce the chunk index value $1/\alpha_3$. As a result, the display device 10*c* can more appropriately reduce power consumption and prevent deterioration in the image quality.

Application Examples

Figure 25:
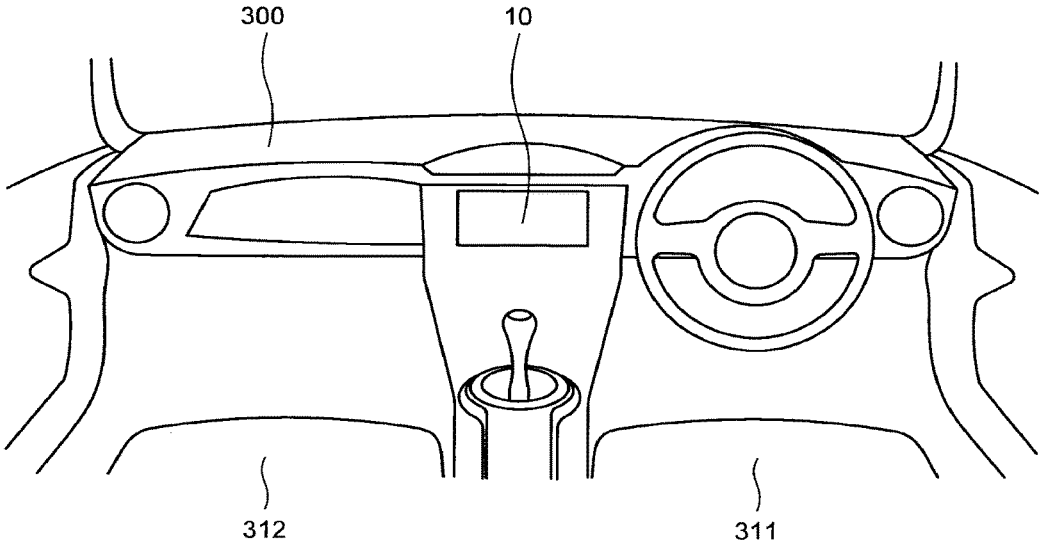
FIG. 25 is a schematic of an example of an electronic apparatus to which the display device according to the first embodiment is applied.
Figure 26:
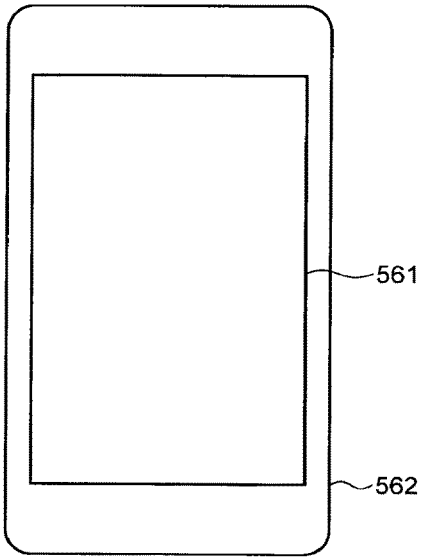
FIG. 26 is a schematic of an example of an electronic apparatus to which the display device according to the first embodiment is applied.

The following describes application examples of the display device 10 according to the first embodiment with reference to FIGS. 25 and 26. FIGS. 25 and 26 are schematics of examples of an electronic apparatus to which the display device according to the first embodiment is applied. The display device 10 according to the first embodiment is applicable to electronic apparatuses of all fields, such as car navigation systems like the one illustrated in FIG. 25, television apparatuses, digital cameras, notebook personal computers, portable electronic apparatuses like a mobile phone illustrated in FIG. 26, and video cameras. In other words, the display device 10 according to the first embodiment is applicable to electronic apparatuses of all fields that display video signals received from the outside or video signals generated inside thereof as an image or video. The electronic apparatus includes the control device 11 (refer to FIG. 1) that supplies video signals to the display device and controls operations of the display device. The application examples may also be applicable to the display devices according to the other embodiments above besides the display device 10 according to the first embodiment.

The electronic apparatus illustrated in FIG. 25 is a car navigation apparatus to which the display device 10 according to the first embodiment is applied. The display device 10 is arranged on a dashboard 300 in a vehicle. Specifically, the display device 10 is arranged between a driver's seat 311 and a passenger seat 312 on the dashboard 300. The display device 10 of the car navigation apparatus is used to display navigation information, an operating screen for music, or a reproduced movie, for example.

An electronic apparatus illustrated in FIG. 26 is a portable information terminal to which the display device 10 according to the first embodiment is applied. The portable information terminal operates as a mobile computer, a multifunctional mobile phone, a mobile computer capable of making a voice call, or a mobile computer capable of performing communications and may be called a smartphone or a tablet terminal. The portable information terminal includes a display unit 561 on the surface of a housing 562, for example. The display unit 561 has the display device 10 according to the first embodiment and a function of touch detection (what is called a touch panel) that can detect an external proximity object.

While the embodiments according to the present invention have been described above, the embodiments are not limited to content thereof. The components described above include components that are easily conceivable by those skilled in the art, substantially the same components, and what is called an equivalent. The components described above can also be combined with each other as appropriate. In addition, the components can be omitted, replaced, or modified in various ways without departing from the gist of the embodiments described above.

What is claimed is:

1. A display device comprising:

an image display panel in which a plurality of pixels are arranged in a two-dimensional matrix;

a light source unit that outputs light to the image display panel; and a signal processing circuitry that controls the pixels based on an input signal of an image and controls an irradiation amount of light from the light source unit, wherein the signal processing circuitry comprises:

a tentative expansion coefficient calculating circuitry that calculates, for each of the pixels, a tentative expansion coefficient serving as a tentative coefficient used to expand the input signal of the image;

a tentative index value calculating circuitry that calculates, for each of the pixels, a tentative index value serving as an index used to calculate the irradiation amount of light from the light source unit based on the tentative expansion coefficient;

a low-saturation pixel detecting circuitry that detects low-saturation pixels having saturation based on the input signal lower than certain saturation in a certain region serving as at least one of a plurality of regions obtained by dividing an image display surface of the image display panel; and a light irradiation amount calculating circuitry that calculates a comparative light irradiation amount based on a result of detection performed by the low-saturation pixel detecting circuitry, a display quality maintenance reference value at which a display quality of a color displayed by the low-saturation pixels is maintained, and an index value calculated based on the tentative index value of pixels included in the certain region and calculates, based on the comparative light irradiation amount, a light irradiation amount serving as the irradiation amount of light output from the light source unit to the certain region.

2. The display device according to claim 1, wherein the signal processing circuitry further comprises:

a chunk calculating circuitry that determines whether the tentative index value is continuous in a plurality of pixels, determines, when determining that the tentative index value is continuous, a region of continuous pixels to be a chunk, and determines the tentative index value of the continuous pixels to be a chunk tentative index value, and the index value is calculated based on the chunk tentative index value of the chunk included in the certain region.

3. The display device according to claim 2, wherein the signal processing circuitry further comprises:

a low-saturation pixel number determining circuitry that determines whether number of the low-saturation pixels detected by the low-saturation pixel detecting circuitry is larger than a certain threshold, and the light irradiation amount calculating circuitry determines, when the number of the low-saturation pixels is larger than the certain threshold, one having a larger irradiation amount of light between the index value and the display quality maintenance reference value to be the comparative light irradiation amount and determines, when the number of the low-saturation pixels is equal to or smaller than the certain threshold, the index value to be the comparative light irradiation amount.

4. The display device according to claim 3, wherein the signal processing circuitry further comprises:

a region tentative index value calculating circuitry that calculates a region tentative index value indicating an index of the irradiation amount of light common to all pixels in the certain region based on the tentative index value of each of the pixels in the certain region, and the light irradiation amount calculating circuitry determines one having a larger irradiation amount of light between the comparative light irradiation amount and the region tentative index value to be the light irradiation amount.

5. The display device according to claim 2, wherein the chunk calculating circuitry detects a chunk composed of the low-saturation pixels and determines a chunk tentative index value of the low-saturation pixels to be the display quality maintenance reference value, and the light irradiation amount calculating circuitry determines one having a larger irradiation amount of light between the index value and the display quality maintenance reference value to be the comparative light irradiation amount.

6. The display device according to claim 1, wherein the signal processing circuitry further comprises:

a chunk tentative index value calculating circuitry that determines whether the tentative index value is continuous in a plurality of pixels, that determines, when determining that the tentative index value is continuous, a region of continuous pixels to be a chunk, and that determines the tentative index value of the continuous pixels to be a chunk tentative index value;

a correction value calculating circuitry that calculates a correction value based on a hue of the pixels included in the chunk; and a chunk index value calculating circuitry that calculates a chunk index value based on the chunk tentative index value and the correction value, and the index value is calculated based on the chunk index value of the chunk included in the certain region.

7. The display device according to claim 1, wherein the signal processing circuitry further comprises a display quality maintenance reference value calculating circuitry that calculates the display quality maintenance reference value based on the tentative index values of the low-saturation pixels.

8. The display device according to claim 7, wherein the display quality maintenance reference value calculating circuitry determines the tentative index value that maximizes the irradiation amount of light out of the tentative index values of the low-saturation pixels to be the display quality maintenance reference value.

9. The display device according to claim 7, wherein the display quality maintenance reference value calculating circuitry classifies an allowable value range of the tentative index value into a plurality of grades, classifies the tentative index values of the low-saturation pixels into the grades according to a frequency distribution, detects grades having a certain number or more of classified low-saturation pixels, selects a largest grade having a largest value in the value range out of the detected grades, and determines the value in the selected grade to be the display quality maintenance reference value.

10. The display device according to claim 1, wherein the pixels each include a first sub-pixel that displays a first color, a second sub-pixel that displays a second color, a third sub-pixel that displays a third color, and a fourth sub-pixel that displays a fourth color, the signal processing circuitry converts an input value of the input signal into an extended value in a color space extended by the first color, the second color, the third color, and the fourth color to generate an output signal and outputs the generated output signal to the image display panel, the signal processing circuitry calculates the expansion coefficient used to expand the pixels based on the light irradiation amount, the signal processing circuitry calculates the output signal for the fourth sub-pixel of each of the pixels based on the input signal for the first sub-pixel, the input signal for the second sub-pixel, the input signal for the third sub-pixel, and the expansion coefficient and outputs the output signal to the fourth sub-pixel, the signal processing circuitry calculates the output signal for the first sub-pixel of each of the pixels based on the input signal for the first sub-pixel, the expansion coefficient, and the output signal for the fourth sub-pixel and outputs the output signal to the first sub-pixel, the signal processing circuitry calculates the output signal for the second sub-pixel of each of the pixels based on the input signal for the second sub-pixel, the expansion coefficient, and the output signal for the fourth sub-pixel and outputs the output signal to the second sub-pixel, and the signal processing circuitry calculates the output signal for the third sub-pixel of each of the pixels based on the input signal for the third sub-pixel, the expansion coefficient, and the output signal for the fourth sub-pixel and outputs the output signal to the third sub-pixel.

11. An electronic apparatus comprising:

the display device according to claim 1; and a control device that controls the display device.

12. A display device comprising:

an image display panel in which a plurality of pixels are arranged in a two-dimensional matrix;

a light source unit including a light guide plate and a plurality of light sources arranged facing an entrance surface of the light guide plate; and a signal processing circuitry that controls the pixels based on an input signal of an image and controls an irradiation amount of light from the light source unit, wherein the signal processing circuitry comprises:

a tentative expansion coefficient calculating circuitry that calculates, for each of the pixels, a tentative expansion coefficient serving as a tentative coefficient used to expand the input signal of the image;

a tentative index value calculating circuitry that calculates, for each of the pixels, a tentative index value serving as an index used to calculate the irradiation amount of light from the light source unit based on the tentative expansion coefficient;

a low-saturation pixel detecting circuitry that detects low-saturation pixels having saturation based on the input signal lower than certain saturation in a certain region serving as at least one of a plurality of regions obtained by dividing an image display surface of the image display panel;

a light irradiation amount calculating circuitry that calculates a comparative light irradiation amount based on a result of detection performed by the low-saturation pixel detecting circuitry, a display quality maintenance reference value at which a display quality of a color displayed by the low-saturation pixels is maintained, and an index value calculated based on the tentative index value of pixels included in the certain region and calculates, based on the comparative light irradiation amount, a light irradiation amount serving as the irradiation amount of light output from the light source unit to the certain region; and a chunk calculating circuitry that determines whether the tentative index value is continuous in a plurality of pixels, determines, when determining that the tentative index value is continuous, a region of continuous pixels to be a chunk, and determines the tentative index value of the continuous pixels to be a chunk tentative index value, and the index value is calculated based on the chunk tentative index value of the chunk included in the certain region.

13. The display device according to claim 12, wherein the signal processing circuitry further comprises:

a low-saturation pixel number determining circuitry that determines whether number of the low-saturation pixels detected by the low-saturation pixel detecting circuitry is larger than a certain threshold, and the light irradiation amount calculating circuitry determines, when the number of the low-saturation pixels is larger than the certain threshold, one having a larger irradiation amount of light between the index value and the display quality maintenance reference value to be the comparative light irradiation amount and determines, when the number of the low-saturation pixels is equal to or smaller than the certain threshold, the index value to be the comparative light irradiation amount.

14. The display device according to claim 13, wherein the signal processing circuitry further comprises:

a region tentative index value calculating circuitry that calculates a region tentative index value indicating an index of the irradiation amount of light common to all pixels in the certain region based on the tentative index value of each of the pixels in the certain region, and the light irradiation amount calculating circuitry determines one having a larger irradiation amount of light between the comparative light irradiation amount and the region tentative index value to be the light irradiation amount.

15. The display device according to claim 12, wherein the chunk calculating circuitry detects a chunk composed of the low-saturation pixels and determines a chunk tentative index value of the low-saturation pixels to be the display quality maintenance reference value, and the light irradiation amount calculating circuitry determines one having a larger irradiation amount of light between the index value and the display quality maintenance reference value to be the comparative light irradiation amount.

16. A method for driving a display device including an image display panel in which a plurality of pixels are arranged in a two-dimensional matrix, a light source unit that outputs light to the image display panel, and a signal processing circuitry that controls the pixels based on an input signal of an image and controls irradiation of light from the light source unit, the method for driving the display device comprising:

calculating, for each of the pixels, a tentative expansion coefficient serving as a tentative coefficient used to expand the input signal of the image;

calculating, for each of the pixels, a tentative index value serving as an index used to calculate an irradiation amount of light from the light source unit based on the tentative expansion coefficient;

detecting low-saturation pixels having saturation based on the input signal lower than certain saturation in a certain region serving as at least one of a plurality of regions obtained by dividing an image display surface of the image display panel; and calculating a comparative light irradiation amount based on a result of detection obtained at the detecting the low-saturation pixels, a display quality maintenance reference value at which a display quality of a color displayed by the low-saturation pixels is maintained, and an index value calculated based on the tentative index value of pixels included in the certain region and calculating, based on the comparative light irradiation amount, a light irradiation amount serving as the irradiation amount of light output from the light source unit to the certain region.

17. The method for driving the display device according to claim 16 further comprises:

calculating whether the tentative index value is continuous in a plurality of pixels, determining a region of continuous pixels to be a chunk when determining that the tentative index value is continuous, determining the tentative index value of the continuous pixels to be a chunk tentative index value; and wherein the index value is calculated based on the chunk tentative index value of the chunk included in the certain region.

* * * * *